US009687401B2

(12) United States Patent
Alford et al.

(10) Patent No.: US 9,687,401 B2
(45) Date of Patent: Jun. 27, 2017

(54) PERSON SUPPORT APPARATUSES HAVING EXERCISE THERAPY FEATURES

(71) Applicant: HILL-ROM SERVICES, INC., Batesville, IN (US)

(72) Inventors: Shelley L. Alford, Batesville, IN (US); John V. Harmeyer, Cleves, OH (US); David W. Hornbach, Brookville, IN (US); John Sparkman, Oakwood, OH (US); Robert M. Zerhusen, Cincinnati, OH (US); Michael P. Bish, Lawrenceburg, IN (US); Nabil Mehdi, West Chester, OH (US); Andreas Schabbach, Nauort (DE)

(73) Assignee: Hill-Rom Services, Inc., Batesville, IN (US)

( * ) Notice: Subject to any disclaimer, the term of this patent is extended or adjusted under 35 U.S.C. 154(b) by 78 days.

(21) Appl. No.: 14/442,912

(22) PCT Filed: Nov. 15, 2013

(86) PCT No.: PCT/US2013/070326

§ 371 (c)(1),
(2) Date: May 14, 2015

(87) PCT Pub. No.: WO2014/078667

PCT Pub. Date: May 22, 2014

(65) Prior Publication Data

US 2015/0290061 A1 Oct. 15, 2015

Related U.S. Application Data

(60) Provisional application No. 61/727,467, filed on Nov. 16, 2012, provisional application No. 61/778,957, filed on Mar. 13, 2013.

(51) Int. Cl.
*A63B 23/08* (2006.01)
*A61G 7/05* (2006.01)
(Continued)

(52) U.S. Cl.
CPC ..... *A61G 7/05* (2013.01); *A61G 7/16* (2013.01); *A63B 21/00178* (2013.01);
(Continued)

(58) Field of Classification Search
CPC ..... A61G 7/005; A61G 7/015; A61G 7/05; A61G 7/0506; A61G 7/0507; A61G 7/075;
(Continued)

(56) References Cited

U.S. PATENT DOCUMENTS 1,561,979 A 11/1925 Gore
2,340,666 A * 2/1944 Johanson ..... A47C 20/022 482/79
(Continued)

FOREIGN PATENT DOCUMENTS

KR 100942968 B1 2/2010
WO 2004039301 A2 5/2004
WO 2009154372 A2 12/2009

OTHER PUBLICATIONS

International Search Report & Written Opinion mailed Mar. 3, 2014, relating to PCT/US2013/070326 filed Nov. 15, 2013.
(Continued)

*Primary Examiner* — Loan H Thanh
*Assistant Examiner* — Gary D Urbiel Goldner
(74) *Attorney, Agent, or Firm* — Dinsmore & Shohl LLP

(57) ABSTRACT

Person support apparatuses having exercise features are disclosed herein. In various embodiments, a person support apparatus includes a support surface, a footboard, a sensor, and a passive resistance mechanism. The support surface has
(Continued)

a foot end and a head end, and the footboard is located near the foot end of the support surface, extending above the support surface. The footboard may include a pressure surface positioned to receive a pressing force. The footboard is freely slidable from an extended position to a retracted position with respect to the foot end of the support surface. The sensor provides a signal indicative of a magnitude of the pressing force incident on the pressure surface of the footboard. The passive resistance mechanism is coupled to the footboard, and resists a motion of the footboard to the extended position.

10 Claims, 33 Drawing Sheets

(51) Int. Cl.

| | |
|---|---|
| ***A61G 7/16*** | (2006.01) |
| ***A63B 23/04*** | (2006.01) |
| ***A63B 71/06*** | (2006.01) |
| ***A63B 21/02*** | (2006.01) |
| ***A63B 21/055*** | (2006.01) |
| ***A63B 24/00*** | (2006.01) |
| ***A63B 21/06*** | (2006.01) |
| ***A63B 22/00*** | (2006.01) |
| ***A63B 22/06*** | (2006.01) |
| ***A63B 21/16*** | (2006.01) |
| *A61G 7/005* | (2006.01) |
| *A61G 7/012* | (2006.01) |
| *A61G 7/015* | (2006.01) |
| *A61G 7/018* | (2006.01) |
| *A61G 7/075* | (2006.01) |
| *A63B 21/072* | (2006.01) |
| *A63B 21/22* | (2006.01) |
| *A63B 23/035* | (2006.01) |
| *A63B 21/00* | (2006.01) |

(52) U.S. Cl.

CPC ..... *A63B 21/023* (2013.01); *A63B 21/055* (2013.01); *A63B 21/0615* (2013.01); *A63B 21/1465* (2013.01); *A63B 21/1488* (2013.01); *A63B 21/1672* (2015.10); *A63B 21/4033* (2015.10); *A63B 21/4034* (2015.10); *A63B 21/4045* (2015.10); *A63B 21/4047* (2015.10); *A63B 22/0089* (2013.01); *A63B 22/0605* (2013.01); *A63B 23/03525* (2013.01); *A63B 23/03541* (2013.01); *A63B 23/04* (2013.01); *A63B 23/0405* (2013.01); *A63B 23/0417* (2013.01); *A63B 24/0003* (2013.01); *A63B 24/0062* (2013.01); *A63B 71/0619* (2013.01); *A61G 7/005* (2013.01); *A61G 7/012* (2013.01); *A61G 7/015* (2013.01); *A61G 7/018* (2013.01); *A61G 7/0506* (2013.01); *A61G 7/0507* (2013.01); *A61G 7/075* (2013.01); *A61G 2200/32* (2013.01); *A61G 2200/34* (2013.01); *A61G 2203/44* (2013.01); *A63B 21/00065* (2013.01); *A63B 21/025* (2013.01); *A63B 21/0724* (2013.01); *A63B 21/225* (2013.01); *A63B 23/03508* (2013.01); *A63B 24/0087* (2013.01); *A63B 2024/0009* (2013.01); *A63B 2024/0065* (2013.01); *A63B 2024/0068* (2013.01); *A63B 2071/063* (2013.01); *A63B 2071/0625* (2013.01); *A63B 2208/0233* (2013.01); *A63B 2208/0238* (2013.01); *A63B 2208/0242* (2013.01); *A63B 2208/0252* (2013.01); *A63B 2210/04* (2013.01); *A63B 2210/56* (2013.01); *A63B 2210/58* (2013.01); *A63B 2213/00* (2013.01); *A63B 2220/51* (2013.01); *A63B 2220/56* (2013.01); *A63B 2225/20* (2013.01); *A63B 2225/50* (2013.01); *A63B 2225/62* (2013.01); *A63B 2230/06* (2013.01)

(58) Field of Classification Search

CPC ..... A61G 7/0755; A61G 7/1098; A61G 7/16; A61G 2200/32; A61G 2200/34; A61G 2200/44; A61G 13/1245; A61G 13/125; A47C 19/022; A47C 20/021; A63B 21/00058; A63B 21/00065; A63B 21/00069; A63B 21/00076; A63B 21/00178; A63B 21/00181; A63B 21/002; A63B 21/0023; A63B 21/0058; A63B 21/008; A63B 21/0083; A63B 21/0085; A63B 21/0087; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/05; A63B 21/055; A63B 21/0552; A63B 21/0555; A63B 21/0557; A63B 21/16; A63B 21/1672; A63B 21/4027; A63B 21/4029; A63B 21/4031; A63B 21/4035; A63B 21/4039; A63B 21/4045; A63B 22/087; A63B 22/0089; A63B 23/035; A63B 23/03508; A63B 23/03516; A63B 23/03525; A63B 23/04; A63B 23/0405; A63B 23/0417; A63B 23/0482; A63B 23/0494; A63B 2023/0411; A63B 24/0003; A63B 24/0006; A63B 24/0062; A63B 24/0087; A63B 2024/0009; A63B 2024/0012; A63B 2024/0015; A63B 2024/0065; A63B 2024/0068; A63B 2024/0093; A63B 2024/0622; A63B 71/0009; A63B 71/0054; A63B 71/06; A63B 71/0619; A63B 2071/0063; A63B 2071/0072; A63B 2071/0081; A63B 2071/009; A63B 2071/0625; A63B 2071/063; A63B 2208/0233; A63B 2208/0238; A63B 2208/0242; A63B 2208/0252; A63B 2210/04; A63B 2210/50; A63B 2210/56; A63B 2210/58; A63B 2213/00; A63B 2220/50; A63B 2220/51; A63B 2220/52; A63B 2220/56; A63B 2220/58; A63B 2220/80; A63B 2220/833; A63B 2220/836; A63B 2225/09; A63B 2225/093; A63B 2225/096; A63B 2230/01; A63B 2230/015

See application file for complete search history.

(56) References Cited

U.S. PATENT DOCUMENTS 2,845,063 A * 7/1958 Allen ..... A63B 21/4034 482/79
3,220,022 A * 11/1965 Nelson ..... A61G 7/002 297/423.3
3,524,643 A * 8/1970 Hazelitt, Sr. ..... A63B 22/16 482/80
3,760,801 A 9/1973 Borgeas
4,169,591 A 10/1979 Douglas
4,509,509 A * 4/1985 Bouvet ..... A61H 1/0255 601/15

(56) References Cited

U.S. PATENT DOCUMENTS 4,615,335 A 10/1986 Searcy
4,621,620 A * 11/1986 Anderson ..... A61H 1/0259 482/901
4,798,197 A 1/1989 Nippoldt et al.
4,925,184 A 5/1990 McJunkin, Jr. et al.
5,005,829 A 4/1991 Caruso
5,098,089 A 3/1992 Harrington et al.
5,107,822 A 4/1992 Ohashi
5,181,289 A 1/1993 Kassai
5,207,628 A 5/1993 Graham
5,260,870 A * 11/1993 Tsuchiya ..... A61B 5/224 482/1
5,277,674 A * 1/1994 Tsuchiya ..... A61B 5/224 482/8
5,279,530 A * 1/1994 Hess ..... A63B 21/0552 482/121
5,312,315 A * 5/1994 Mortensen ..... A63B 21/0087 482/113
5,314,390 A * 5/1994 Westing ..... A63B 21/00178 482/111
5,662,591 A 9/1997 Peindl et al.
5,680,661 A 10/1997 Foster et al.
5,740,571 A 4/1998 Tyra
5,820,519 A 10/1998 Slenker
5,827,154 A * 10/1998 Gill ..... A63B 21/153 482/101
5,851,166 A 12/1998 Bernardson
5,860,941 A 1/1999 Saringer et al.
6,212,714 B1 * 4/2001 Allen ..... A61G 7/00 5/184
6,270,445 B1 8/2001 Dean, Jr. et al.
6,371,894 B1 4/2002 Hill
6,611,979 B2 * 9/2003 Welling ..... A61G 7/005 5/600
7,481,751 B1 1/2009 Arnold
7,597,656 B2 10/2009 Trees
7,744,546 B2 * 6/2010 Lee ..... A61H 1/0237 601/24
8,104,123 B2 1/2012 Paz et al.
RE43,155 E * 2/2012 Allen ..... A61G 7/00 5/618
RE43,193 E * 2/2012 Osborne ..... A47C 19/045 5/600
8,117,695 B2 2/2012 Paz et al.
8,249,714 B1 * 8/2012 Hartman ..... A61N 1/36003 607/48
8,262,543 B1 * 9/2012 Batca ..... A63B 23/03525 482/100
8,566,984 B2 10/2013 Paz et al.
2001/0001163 A1 * 5/2001 Allen ..... A61G 7/00 5/624
2007/0157376 A1 * 7/2007 Paz ..... A47C 23/002 4/540
2007/0203434 A1 8/2007 Namgung et al.
2008/0045384 A1 * 2/2008 Matsubara ..... A63B 21/00181 482/4
2009/0137369 A1 * 5/2009 Branch ..... A61H 1/0259 482/112
2010/0234198 A1 * 9/2010 Thulin ..... A63B 21/06 482/142
2011/0077127 A1 * 3/2011 Ishii ..... A63B 23/03525 482/8
2011/0082006 A1 * 4/2011 Ishii ..... A63B 21/0058 482/5
2011/0092339 A1 * 4/2011 Stewart ..... A43B 13/18 482/52
2011/0143898 A1 6/2011 Trees
2011/0251022 A1 10/2011 Lee
2012/0232438 A1 * 9/2012 Cataldi ..... A61H 1/0259 601/5
2013/0139318 A1 6/2013 Paz
2016/0193095 A1 * 7/2016 Roussy ..... A61G 7/002 5/11

OTHER PUBLICATIONS

VitalGo Systems http://www.vitalgosys.com/Orthopedics.html Published Date: Aug. 18, 2013.

* cited by examiner

PERSON SUPPORT APPARATUSES HAVING EXERCISE THERAPY FEATURES

CROSS-REFERENCE TO RELATED APPLICATIONS

This application claims the benefit of U.S. Provisional Application No. 61/727,467, filed Nov. 16, 2012, and U.S. Provisional Application No. 61/778,957, filed Mar. 13, 2013, each of which is incorporated by reference herein in their entirety.

TECHNICAL FIELD

The present specification generally relates to person support apparatuses and, more particularly, to person support apparatuses having exercise therapy features.

BACKGROUND

Recent medical advances have allowed more patients to survive serious injuries or disease processes than ever before. Unfortunately, the period of bed rest required for recovery often leads to severe deterioration of muscle strength and a corresponding inability of the patient to support full body weight upon standing. It is challenging for rehabilitation specialists to help these patients regain the ability to stand and begin ambulation, and the challenge is especially great for obese patients. A common technique in conventional practice is to summon as many colleagues as practical to lift and maneuver the weakened patient to a standing position while he or she attempts to bear full weight through the lower extremities. This technique is not only dangerous, because of the risk of a fall, but it is also psychologically degrading for the patient as the activity reinforces the patient's dependence on others.

Hospital beds have evolved over the years from conventional beds that lie flat to beds that convert into a chair position, allowing patients to begin standing from a sitting position at the foot of the bed. The sitting position does not improve a patient's leg strength and does little for preparing a patient for upright standing. Patients are still required to be lifted by hospital staff as the patient's leg muscles do not have adequate strength to support their weight.

Accordingly, a need exists for alternative person support apparatuses, such as hospital beds and/or patient care beds which enable a person to perform rehabilitation exercises.

SUMMARY

According to some embodiments of the present disclosure, a person support apparatus is provided comprising a support surface, a footboard, and a sensor. The support surface is configured to support a person and has a foot end and a head end. The footboard is located near the foot end of the person support surface and extends above the support surface. The footboard comprises a pressure surface positioned to receive pressing force from a person's foot. The sensor is configured to provide a signal indicative of the magnitude of the force provided against the pressure surface of the footboard.

According to some embodiments of the present disclosure, a person support apparatus is provided that includes a frame, a support surface supported by the frame and having a head end and a foot end, at least one side rail provided along at least one side of the support surface, and a foot pedal. The foot pedal is supported by at least one of the at least one side rail and the frame, and located closer to the foot end than the head end. The foot pedal is freely slidable with respect to the support surface from a retracted position to an extended position. The foot pedal is also coupled to a passive resistance mechanism that resists a motion of the foot pedal.

According to some embodiments, a person support apparatus is provided that includes a frame, a support surface having a head end and a foot end supported by the frame, at least one side rail provide along at least one side of the support surface, and a physical therapy bar supported by at least one of the side rail and the frame. The physical therapy bar is movable against a force provided by a passive resistance mechanism.

According to some embodiments, a person support apparatus is provided that includes a support surface having a head end and a foot end, a lift system configured to tilt the support surface, a footboard located near the foot end of the support surface and extending above the support surface, and a pad. The pad includes a low friction material facing the support surface, wherein the low friction material enables the pad to slide along the support surface relative to the footboard.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

Referring now to the illustrative examples in the drawings, wherein like numerals represent the same or similar elements throughout.

DETAILED DESCRIPTION

Figure 1A:
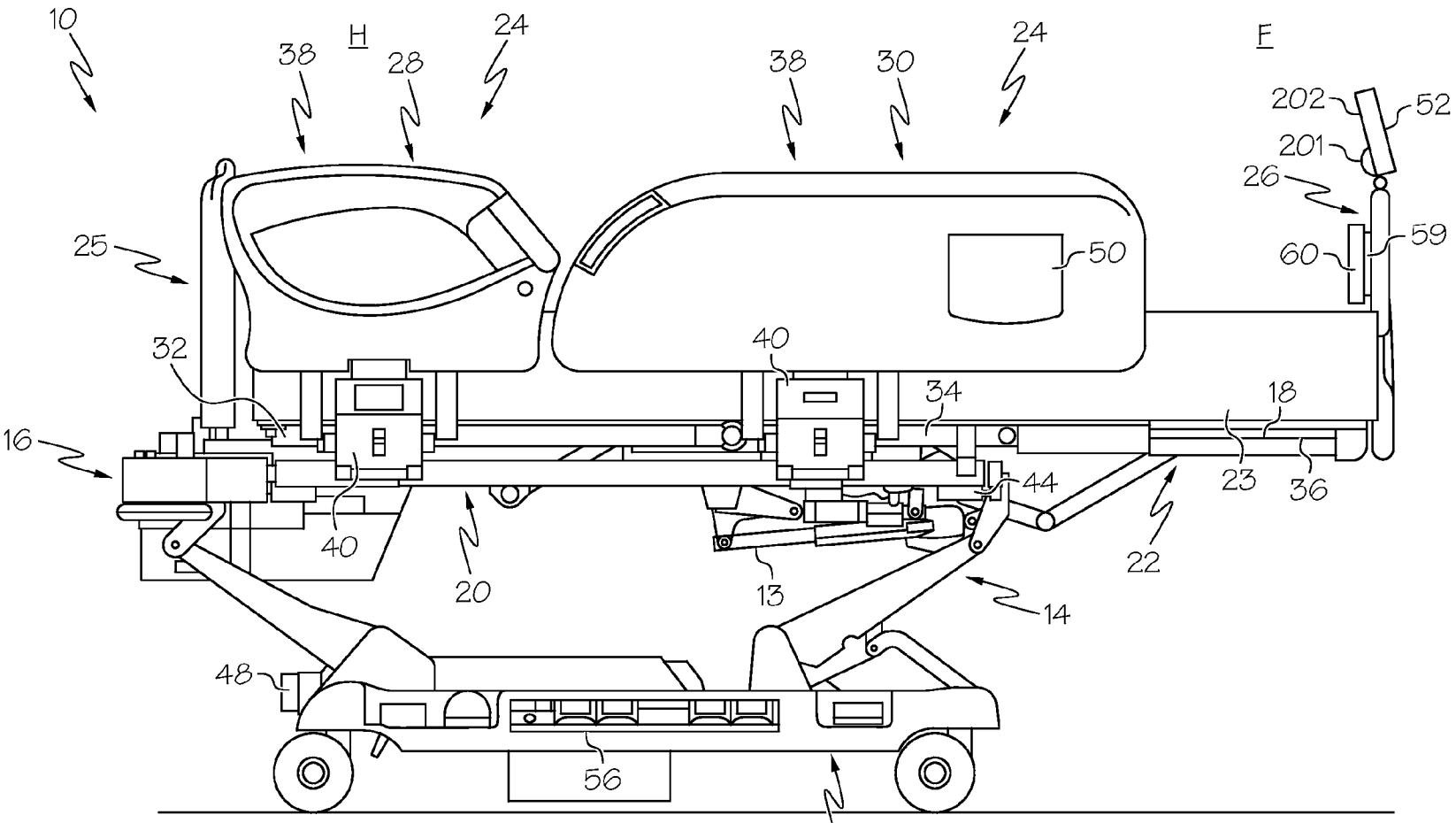
FIG. 1A is a side view of a person support apparatus according to one or more embodiments.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

In the following detailed description, a person support apparatus that can be used in one or more embodiments will first be described. Then, various embodiments including a moveable footboard that can be used to perform a leg press exercise will be described in detail. Next, embodiments including a lateral bar for leg lifts and curls will be described in detail. Various embodiments including foot pedals will then be described, followed by embodiments including bicycle pedals. Then, embodiments including a low friction surface or rollers will be described. Next, an electronic control system that can be configured to provide controls for one or more embodiments will be described. Finally, a conclusion section will highlight various aspects of the embodiments.

Person Support Apparatus

A person support apparatus 10 according to various embodiments is depicted in FIG. 1A. The person support apparatus 10 can be, for example, a hospital bed, a stretcher, a patient lift, a chair, an operating table, or similar support apparatuses commonly found in hospitals, nursing homes, rehabilitation centers or the like. As shown in FIG. 1A, the person support apparatus 10 includes a lower frame 12, a plurality of lift members 14 coupled to the lower frame 12, and an upper frame 16 movably supported by the plurality of lift members 14 above the lower frame 12. In various embodiments, the person support apparatus 10 includes a support surface 18 that is supported by the upper frame 16. The support surface 18 has a first section, designated as head end H, and a second section, designated as foot end F. The support surface 18 may be, for example, a deck 22.

The lift members 14 are coupled to various linear actuators 13 (such as jack motors and the like) and related mechanical and electrical components which facilitate raising, lowering and tilting the support surface 18 with respect to the lower frame 12 and articulating various portions and/or segments of both the upper frame 16 and the deck 22. Tilting of the support surface 18 relative to the lower frame 12 may also be referred to herein as orienting the support surface 18 in a Trendelenburg orientation or a reverse Trendelenburg orientation. In a Trendelenburg orientation, the head end H of the support surface 18 is lower than the foot end F of the support surface 18 while in a reverse Trendelenburg orientation, the foot end F of the support surface 18 is lower that the head end H of the support surface 18.

In embodiments, the upper frame 16 can include an upper frame base 20 which supports the deck 22. The person support apparatus 10 may further include side rails 24, a headboard 25, and a footboard 26. The side rails 24, headboard 25, and footboard 26 are supported by the upper frame 16, as shown in FIG. 1A. The side rails 24, the headboard 25, and the footboard 26 are affixed to the upper frame 16 such that they generally define the perimeter edge of the upper frame 16. In some embodiments, the side rails 24 may include multiple sections. For example, in some embodiments the side rails 24 may each include a head side rail 28, located adjacent to the head end H of the support surface 18, and an intermediate side rail 30 positioned between the head side rail 28 and the foot end F.

Figure 1B:
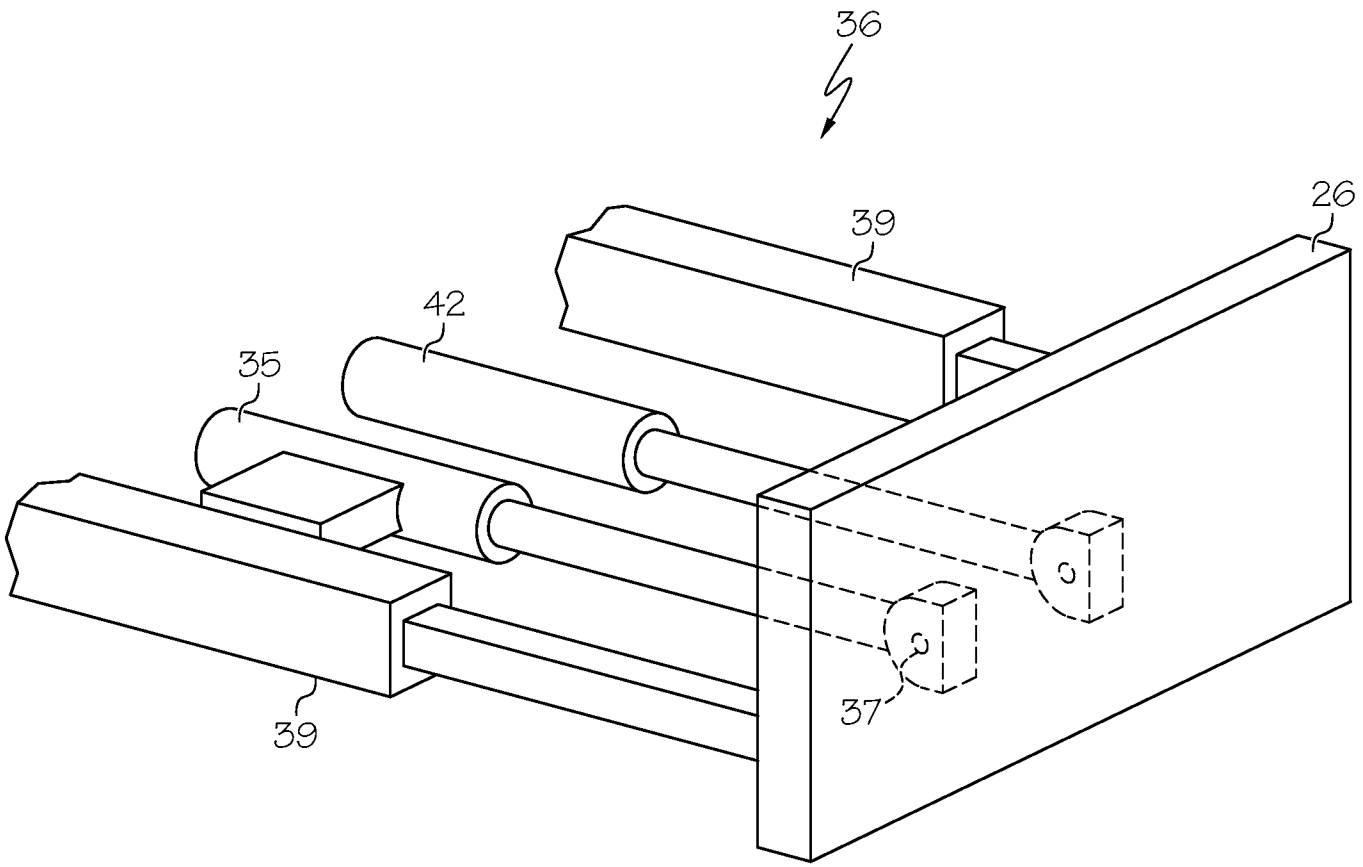
FIG. 1B depicts an extendable foot section of a person support apparatus according to one or more embodiments.

The upper frame base 20 is coupled to the lift members 14 and supports the support surface 18. The deck 22 includes a head portion 32, a seat portion 34, and an extendable foot section 36 coupled to the upper frame base 20. The extendable foot section 36 is configured to move between an extended position and a retracted position with respect to the upper frame base 20. For example, as depicted in FIG. 1B, a standard linear actuator 35 may be coupled to the extendable foot section 36 of the deck 22 in order to enable the length of the person support apparatus 10 to be adjusted to accommodate the height of a person. For example, the extendable foot section 36 may be retracted to shorten the length of the person support apparatus 10 for a child, but may be extended to lengthen the person support apparatus 10 for an adult. To facilitate the extension and retraction of the foot section 36 with respect to the seat portion 34, the extendable foot section 36 may be constructed with telescoping rail members 39 and/or linear bearings which allow the extendable foot section 36 to slide with respect to the seat portion 34. In embodiments, automatic (i.e., active) extension and retraction of the extendable foot section 36 may be accomplished with the actuator 35, which may automatically extend and retract the extendable foot section 36 based on signals received from a control unit. In embodiments, the extendable foot section 36 may also be freely slidable with respect to the upper frame base 20 so as to facilitate a leg press exercise by a person, as described in more detail herein, such as when the actuator 35 is decoupled from the extendable foot section 36.

Returning to FIG. 1A, in some embodiments, the head side rail 28 is coupled to the head portion 32 of the deck 22 and the intermediate side rail 30 is coupled to the seat portion 34 of the deck 22. The head side rail 28 includes a side rail body 38 and a movement assembly 40 as shown in FIG. 1A. The side rail movement assembly 40 is configured to movably couple the side rail body 38 to the upper frame 16 and move the side rail body 38 between a deployed position and a stowed position. When the head side rail 28 is in the deployed position, at least a portion of the head side rail 28 is positioned above the deck 22 and/or the mattress 23. When the head side rail 28 is in the stowed position, the head side rail 28 is positioned below at least the mattress 23. In embodiments, the head side rail 28 may also be positioned below the deck 22 when in the stowed position. In some embodiments, the movement assembly 40 includes a locking mechanism (not shown) that is configured to maintain the side rail body 38 in the deployed position and/or the stowed position.

The intermediate side rail 30 includes a side rail body 38 and a movement assembly 40 as shown in FIG. 1A. The side rail movement assembly 40 is configured to movably couple the side rail body 38 to the upper frame 16 and move the side rail body 38 between a deployed position and a stowed position. When the intermediate side rail 30 is in the deployed position, at least a portion of the intermediate side rail 30 is positioned above the deck 22 and/or the mattress 23. When the intermediate side rail 30 is in the stowed position, the intermediate side rail 30 is positioned below at least the mattress 23. In embodiments, the intermediate side rail 30 may also be positioned below the deck 22 when in the stowed position. In some embodiments, the movement assembly 40 includes a locking mechanism (not shown) that is configured to maintain the side rail body 38 in the deployed position and/or the stowed position.

In the embodiment depicted in FIG. 1A, person support apparatus 10 further comprises a user interface 52. In the embodiment of the person support apparatus 10 shown in FIG. 1A, the user interface 52 is coupled to the footboard 26 of the person support apparatus 10. However, it should be understood that the user interface 52 may be located elsewhere on the person support apparatus 10, including, for example, on the side rails 24. In embodiments, the user interface 52 may include a speaker 201 and/or a display 202. In embodiments, the user interface may be coupled to a pressure surface 60 which is mounted to the footboard 26 of the person support apparatus. In the embodiment shown in FIG. 1A, the footboard 26 is located near the foot end F and extends above the support surface 18. In this embodiment, the footboard 26 is affixed to the extendable foot section 36 such that the footboard 26 is positionable between the extended position and the retracted position with extendable foot section 36. The pressure surface 60 may include a sensor 59, such as a flexing force pressure sensor, which measures the amount of force applied to the sensor 59. The sensor 59 may be, for example, an integrated load cell sensor such as those that measure weight. However, other force-sensing technologies may be utilized, such as pressure-sensitive resistors, capacitive force sensors, and piezoelectric transducers, for example.

Figure 1C:
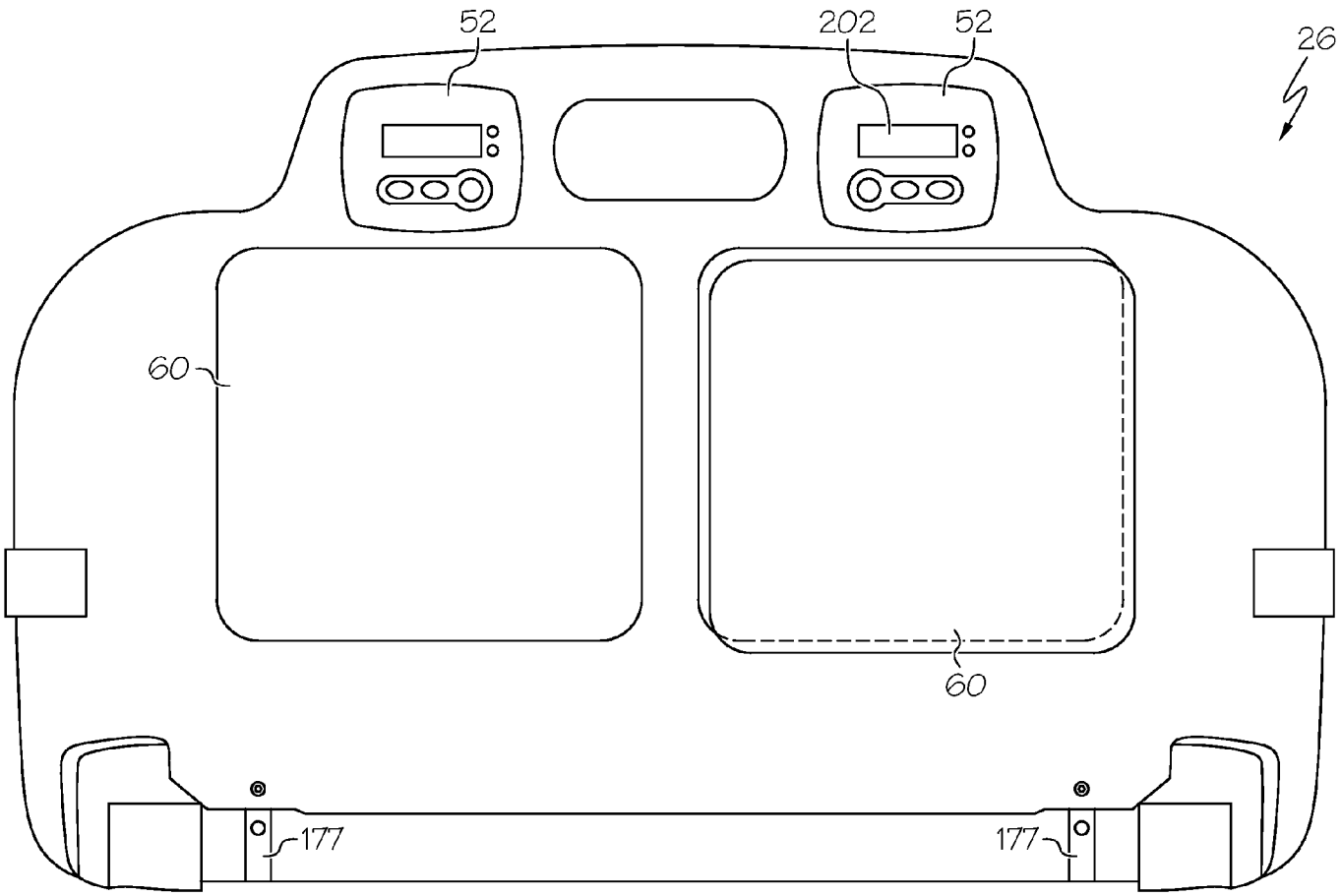
FIG. 1C depicts a footboard including strain gauge pedals according to one or more embodiments.

FIG. 1C depicts an embodiment in which a footboard 26 includes pressure surfaces 60 mounted to the inboard (person facing side) of the footboard 26. Each pressure surface 60 includes a sensor 59 in the form of an electronic system and strain gauge (not shown) which detects the amount of force being exerted against the pressure surface 60 by the person. A signal representing the force is then provided to the user interface 52 which can display the force provided at each pressure surface 60, or the combined or average force, on the display 202. The footboard 26 can be placed onto the foot end of a person support apparatus by using the pins 177. As an alternative to strain gauges, other force sensors can be utilized, such as load cells, pressure sensors, and the like.

In various embodiments, a person positioned on the person support apparatus 10 can push upon the pressure surface 60 and the amount of force imparted to the pressure surface is detected by the sensor 59, and the resulting force, the number of applications of force (i.e., repetitions) and other data detected with the sensor may be communicated to the user interface 52 and processed and/or displayed.

As noted hereinabove, the user interface 52 may be in the form of or include a display 202. The display 202 may be a touchscreen, LCD screen, or other suitable display. The user interface 52 displays information about a person's use of the pressure surface 60 for therapeutic strength training and/or monitoring. For example, the user interface 52 can display the number of applications of force to the pressure surface 60, the length of time that the pressure surface 60 was used by the person, a stroke length, a percent of completion of an exercise or therapy routine, and/or the amount of force that the person applied to the pressure surface 60. Additionally, the user interface 52 may monitor these parameters and provide historical trends indicative of changes over time, for example, by hour, by day, or by week. Moreover, the user interface 52 may display words of encouragement regarding the use of the pressure surface 60 (e.g., "Keep It Up", "Almost Done", "Just One More", "You Can Do It", "Great Job", etc.) Optionally, the user interface 52 may contain a speaker 201, as described above. The speaker 201 can be used for providing audible signaling to a person positioned in the support apparatus 10. For example, in one embodiment, the user interface 52 may play audible words of encouragement through the speaker. In other embodiments, the user interface 52 may give audible indicators related to exercise progress to a user.

Figure 1D:
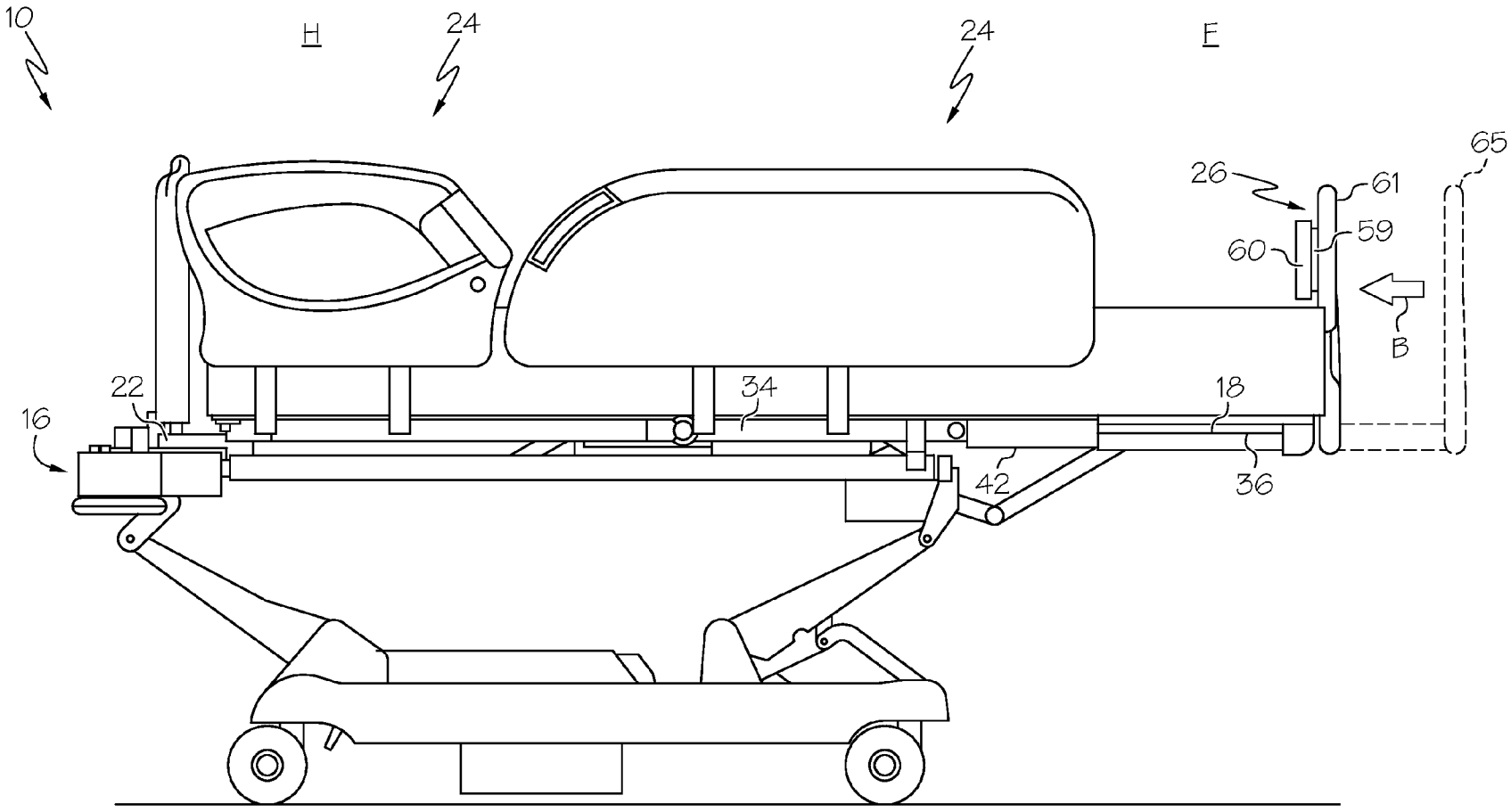
FIG. 1D is a simplified side view of the person support apparatus of FIG. 1A.

Turning now to FIG. 1D, a simplified view of an embodiment of the person support apparatus 10 is depicted. As described hereinabove, the person support apparatus 10 includes a support surface 18 having a foot end F and a head end H, a footboard 26 coupled to the extendable foot section 36, and a sensor 59. Various embodiments further include a frame, e.g., upper frame 16, that supports the support surface 18, the footboard 26, and the sensor 59. The upper frame 16 may directly or indirectly support the support surface 18, the footboard 26, and the sensor 59. For example, in some embodiments, the footboard 26 and/or the sensor 59 are directly supported by the support surface 18, and the support surface 18 is supported by the upper frame 16. Accordingly, in such embodiments, the footboard 26 and/or the sensor 59 are indirectly supported by the upper frame 16.

The footboard 26 is located near the foot end F of the person support apparatus 10 and extends above the support surface 18. In various embodiments, the footboard 26 includes a pressure surface 60 that is positioned to receive a pressing force exerted against the footboard 26, such as a force from a person's foot. The footboard 26 is freely slidable between a retracted position 61 to an extended position 65 with respect to the foot end F and/or the upper frame 16.

In embodiments, the extendable foot section 36 may further include a passive resistance mechanism 42. As used herein, the phrase "passive resistance mechanism" refers to any resistance mechanism that resists the motion of the extendable foot section from a nominal position without actively moving the extendable foot section 36. For example, the passive resistance mechanism may comprise one or more air springs, coil springs, elastically deformable resistance bands, or the like. The passive resistance mechanism 42 is coupled to the footboard 26, and resists a motion of the footboard 26 to the extended position and thus provides a passive mechanical resistance to a person performing a leg-press type exercise on the person support apparatus 10. The passive resistance mechanism 42 generally biases the extendable foot section 36 (and attached footboard 26) towards the retracted position 61 and resists transitioning the extendable foot section 36 from the retracted position 61 to the extended position 65 with a biasing force B. In some embodiments, the passive resistance mechanism 42 biases the footboard 26 to a neutral position. The neutral position may be an intermediate position between the extended position 65 and the retracted position 61. In some embodiments, the neutral position is the retracted position 61.

In embodiments, the passive resistance mechanism 42 may provide a variable biasing force B. For example, in embodiments where one or more coil springs and/or elastically deformable resistance bands are utilized, the coil springs or elastically deformable bands may be removably attached between the seat portion 34 and the extendable foot section 36 of the deck 22. The number of coil springs and/or elastically deformable bands connected between the seat portion 34 and the extendable foot section 36 may be selectively varied to increase or decrease the biasing force B and thereby vary the resistance experienced by a user performing a leg-press type exercise with the person support apparatus 10. Alternatively, when the passive resistance mechanism 42 includes one or more air springs, the air springs may be coupled between the seat portion 34 and the extendable foot section 36 of the deck 22. The resistance of each individual air spring may be separately adjusted or, alternatively, one or more of the air springs may be decoupled from either the seat portion 34 and/or the extendable foot section 36 to vary the biasing force B.

As described hereinabove, the sensor 59 is configured to provide a signal indicative of a magnitude of the pressing force incident on the pressure surface 60 of the footboard 26. For example, the sensor 59 may provide a signal indicative of the magnitude of the pressing force incident on the pressure surface 60 that overcomes the biasing force B of the passive resistance mechanism 42 to slide the footboard 26 from the retracted position 61 to the extended position 65.

Figure 2:
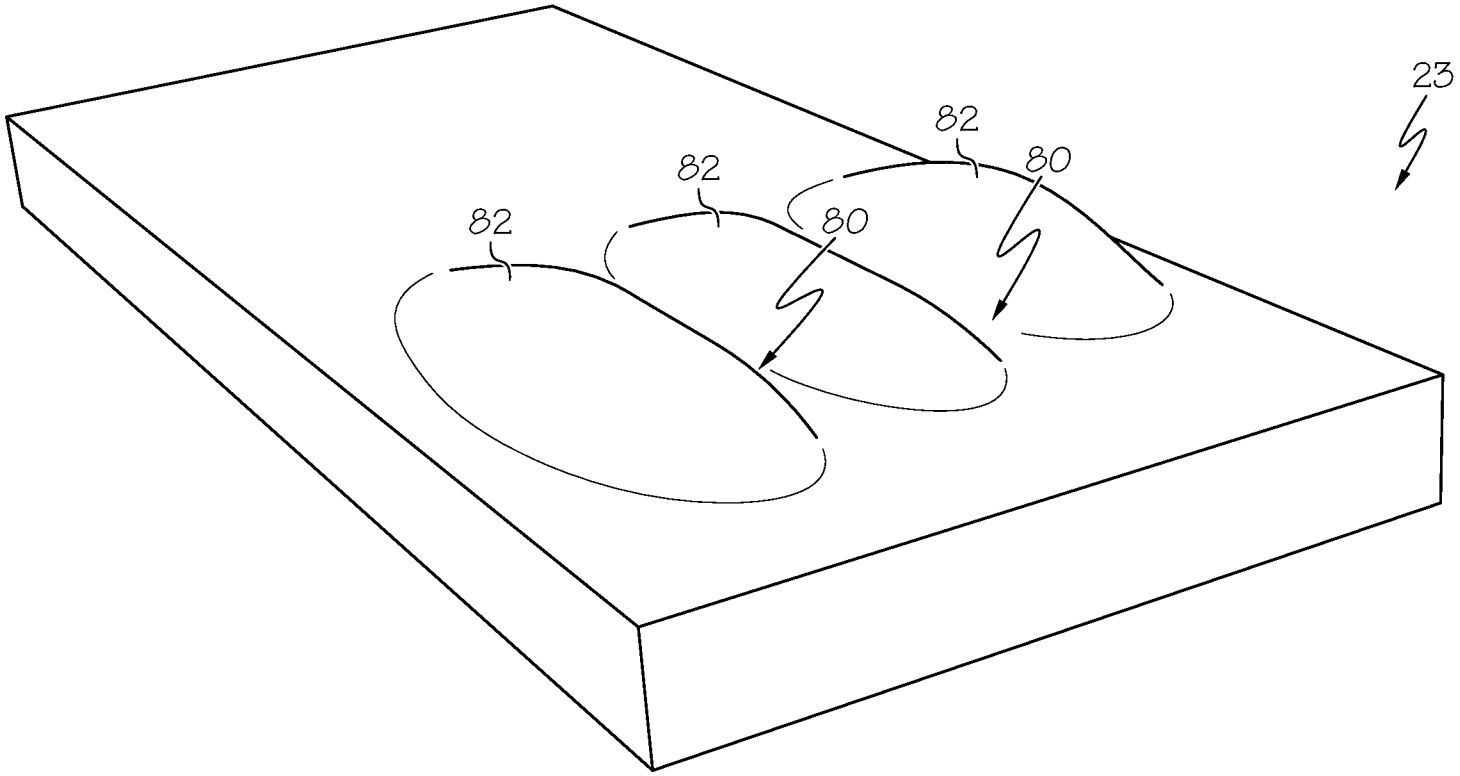
FIG. 2 is a perspective view of the mattress according to one or more embodiments.

In various embodiments, the mattress 23 may have a top surface with a knee support area. For example, the top surface of the mattress 23 can have raised supports extending above the support surface. In some embodiments, the top surface of the mattress 23 may be formed to receive a person's legs in order to ensure that the person is properly positioned on the person support apparatus 10, as shown in FIG. 2. As shown in this embodiment, three positioning pads 82 are integrally formed in the mattress 23. Together, the pads 82 form a pair of recesses 80 that receive and guide a person's legs. When the person's legs are placed in the recesses 80, the positioning pads 82 hold the person's legs in the correct position while exercising/pushing on the footboard 26. Accordingly, the mattress 23 may provide passive guidance to the person to enable the person to utilize the footboard 26, or another exercise therapy feature described herein, with proper form.

In embodiments, the positioning pads 82 may be integrally formed in the mattress 23, such as when the mattress 23 is constructed of a molded, foam-type material, such as urethane foam or the like. Alternatively, the positioning pads 82 may comprise inflatable bladders that are disposed within the mattress 23. In this embodiment, the inflatable bladders may be coupled to a pneumatic system (not shown) such that the bladders may be selectively inflated and deflated. For example, when the user support apparatus 10 is being used to perform exercises, such as the leg press exercise described herein above, the bladders may be inflated to provide passive guidance to the user. However, when the user support apparatus 10 is not being used for exercises (such as when the user support apparatus 10 is being used conventionally as a bed) the inflatable bladders may be deflated, thereby providing a more conventional support surface.

Figure 3:
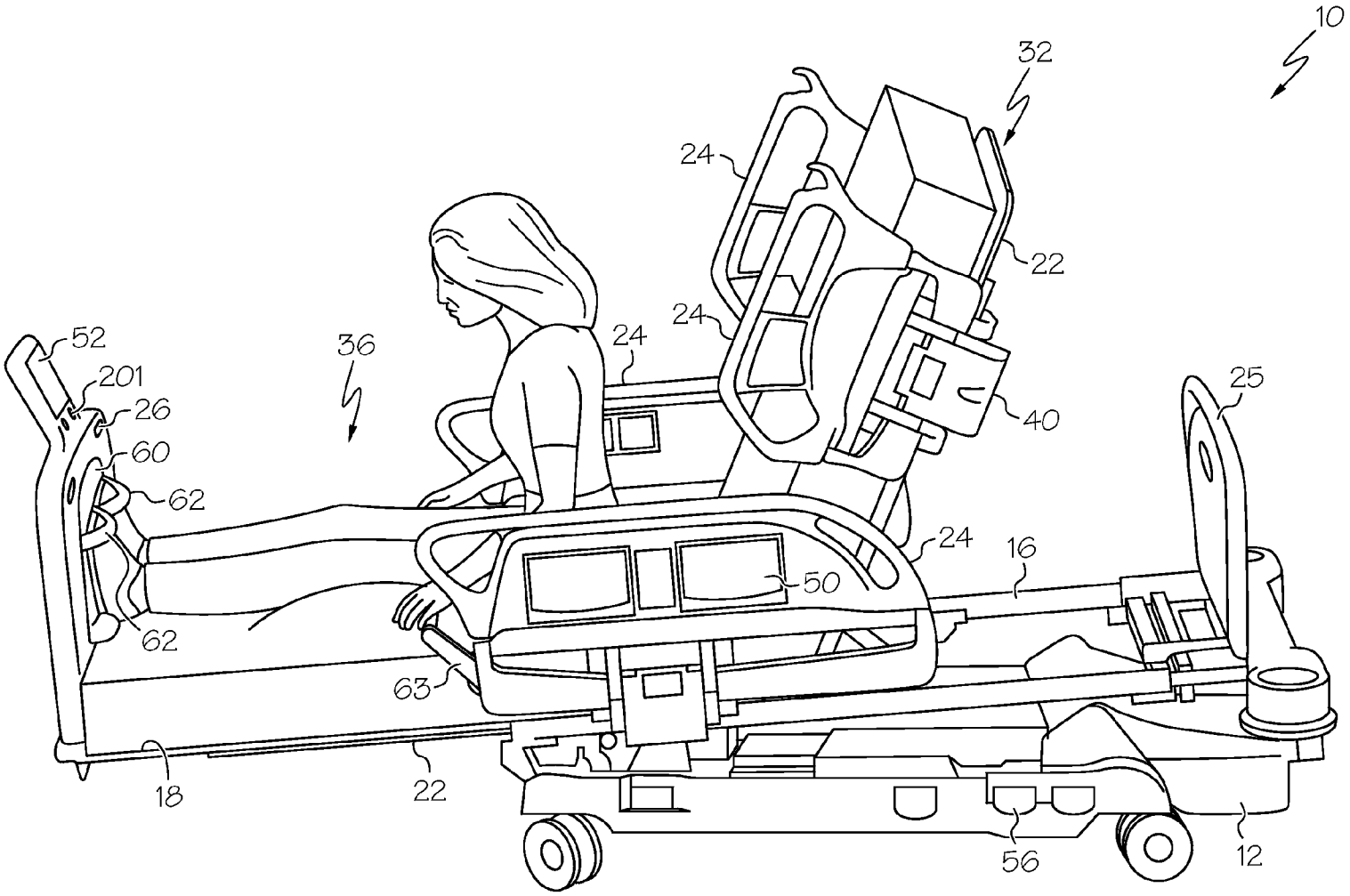
FIG. 3 illustrates a person support apparatus having a head section pivoted with respect to the upper frame according to one or more embodiments.
Figure 4:
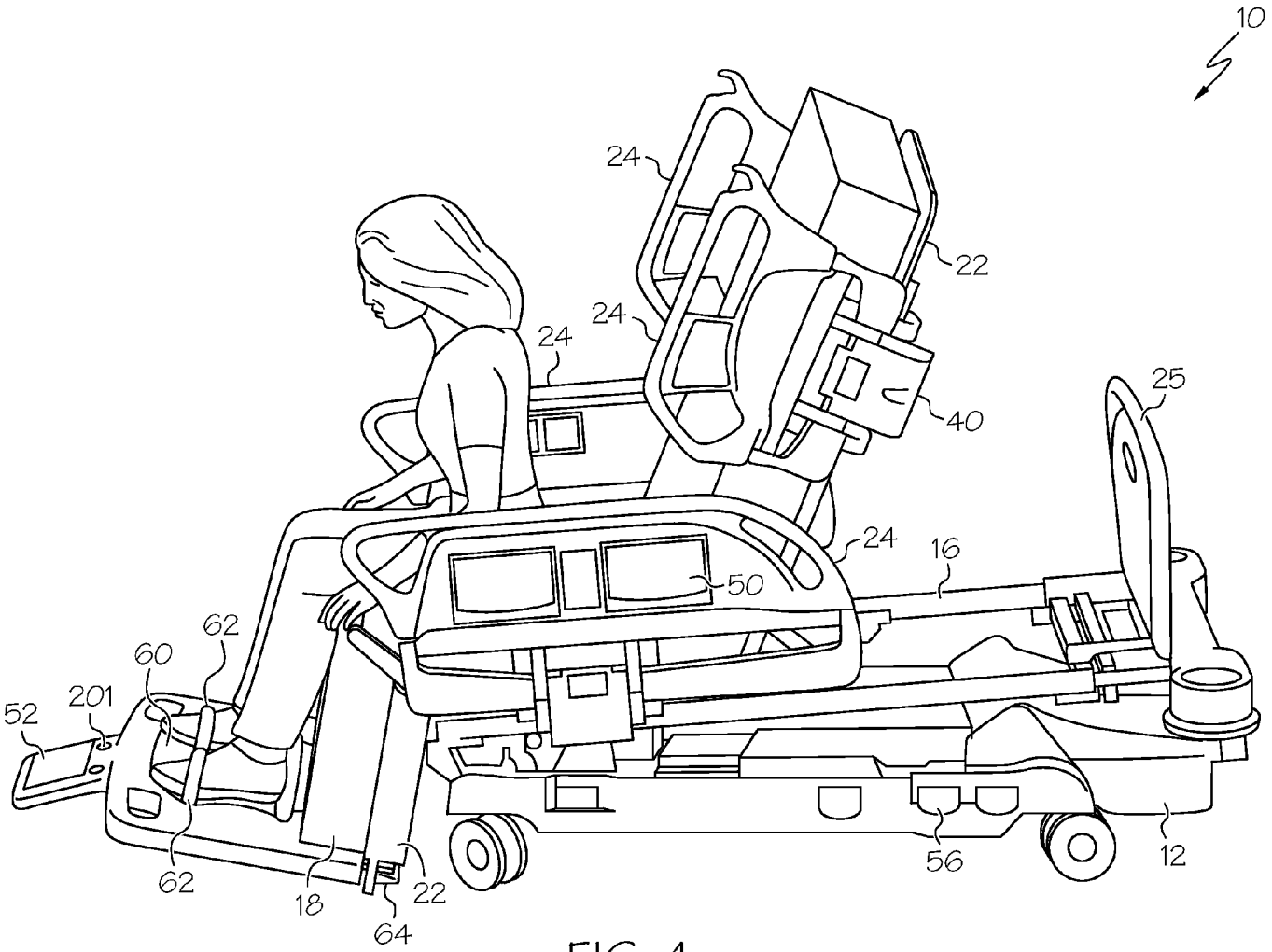
FIG. 4 illustrates a person support apparatus having a head section and a foot section pivoted with respect to the upper frame according to one or more embodiments

As described above, in some embodiments, the deck 22 includes a head portion 32, a seat portion 34, and an extendable foot section 36. Each section is pivotally coupled to the upper frame base 20 and/or one another and is configured to move with respect to the upper frame base 20 and/or one another. Accordingly, the support surface 18 may support a person in various articulated positions. For example, the head portion 32 may pivot with respect to the seat portion 34 and the foot section 36, such that the user is sitting up on the deck 22, as shown in FIG. 3. In some embodiments, the foot section 36 may also pivot with respect to the seat portion 34 and the head portion 32, such that the person support apparatus 10 is in a chair configuration, as depicted in FIG. 4. The pivoting and/or movement of each section may be controlled by controls configured to operate one or more linear actuators attached to each section. The set of controls may be incorporated in the side rails 24 or may take the form of a wired or wireless remote control. Various exercises may be performed while the support surface 18 is in one or more of these articulated positions, as will be described in greater detail below.

Having described an exemplary person support apparatus in general, various features of the person support apparatus including exercise therapy configurations in accordance with one or more embodiments will now be described.

Movable Footboard for Leg Press

Figure 5:
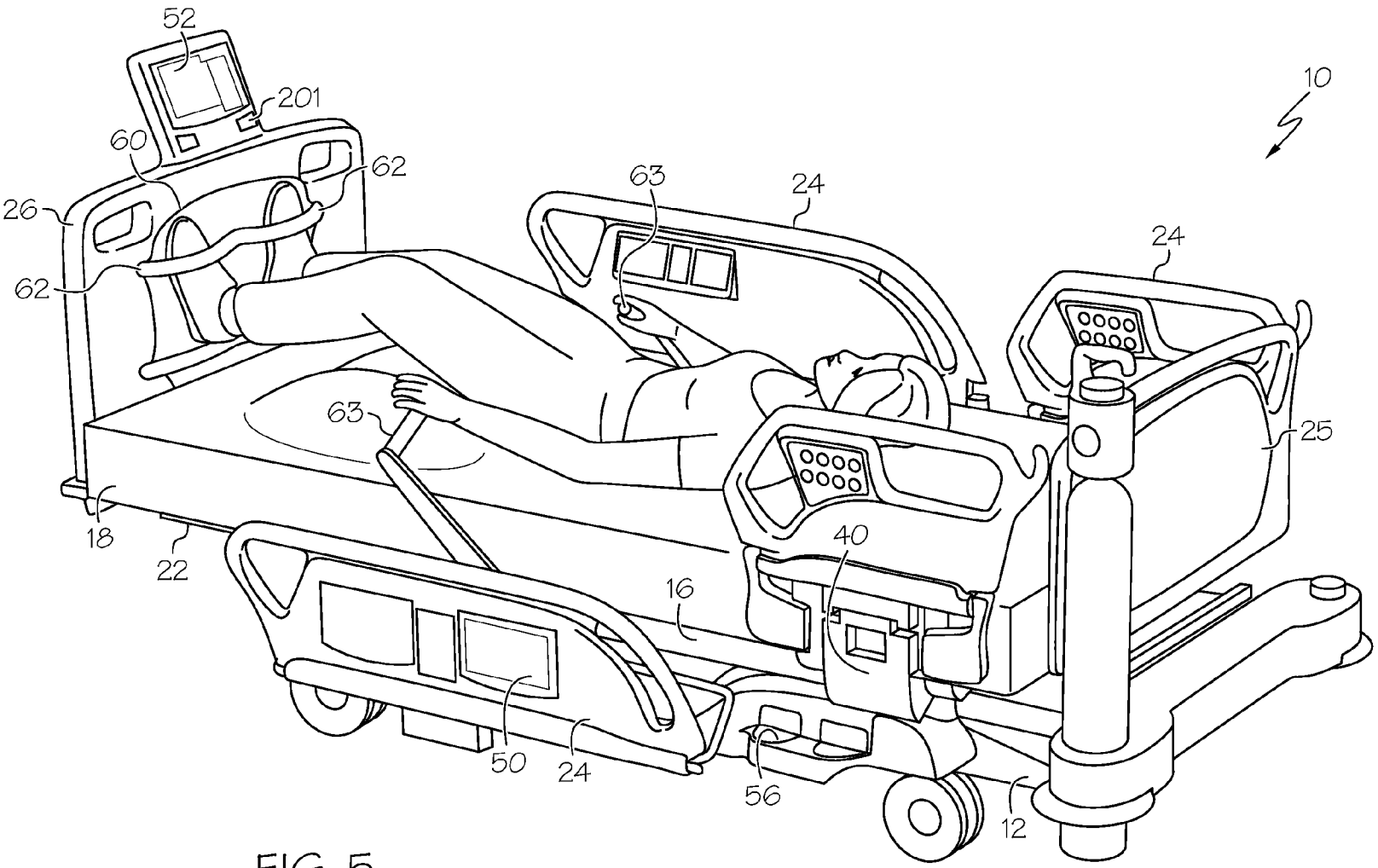
FIG. 5 is a perspective view of a person support apparatus showing the person's feet engaged with the footboard in a retracted position according to one or more embodiments.
Figure 6:
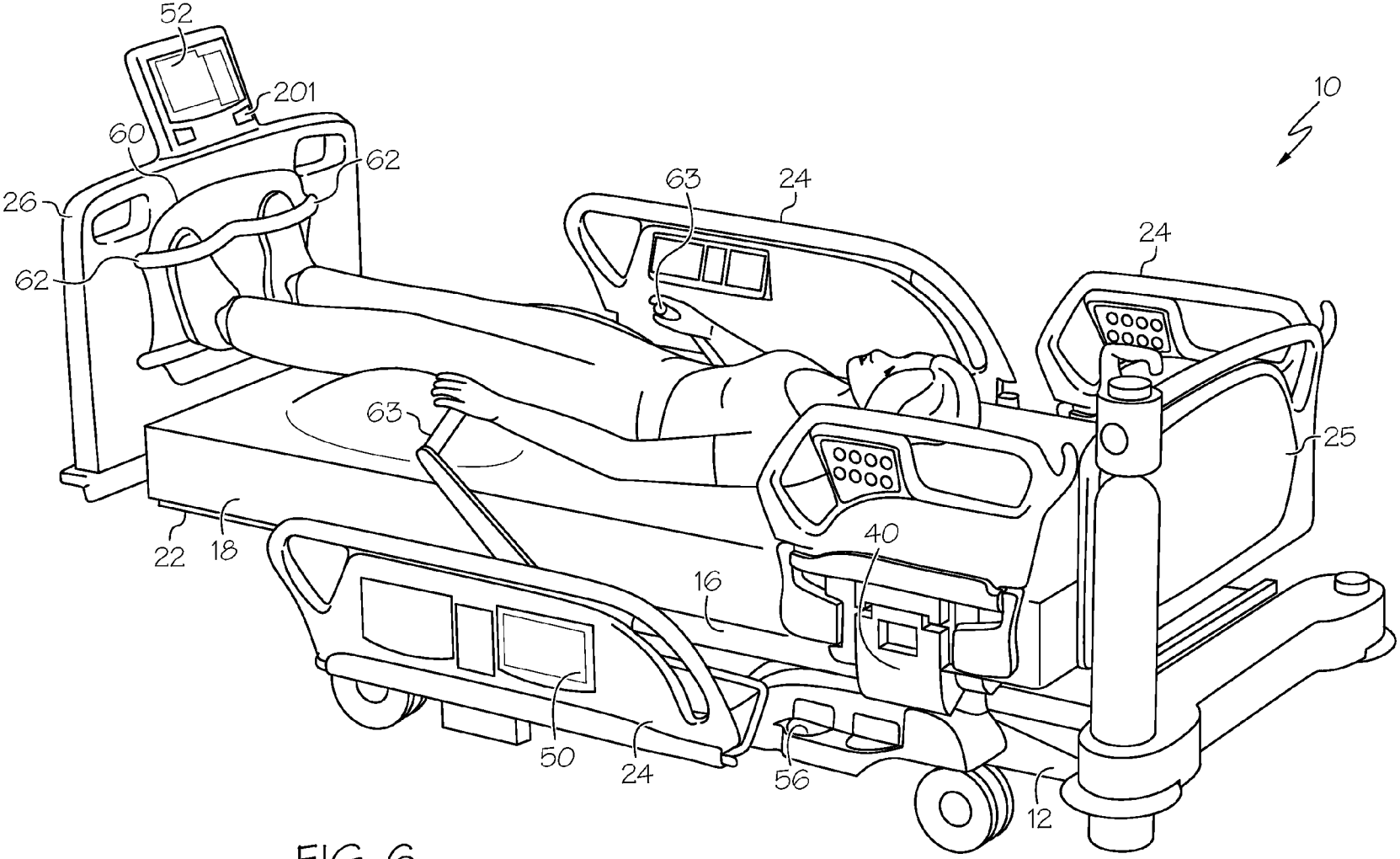
FIG. 6 is a perspective view of a person support apparatus showing the person's feet extending the footboard outwardly in an extended position according to one or more embodiments.

Referring now to FIGS. 5 and 6, a person using the person support apparatus 10 to perform one or more leg exercises is depicted. In particular, the person is illustrated using the person support apparatus 10 to perform a leg press exercise with the footboard 26. As described hereinabove, the person support apparatus 10 includes a lower frame 12 and an upper frame 16. The mattress 18 is supported by the deck 22 of the person support apparatus 10. As shown in FIG. 5, the side rails 24 are provided along the sides of the person support apparatus 10 and the headboard 25 and the footboard 26 are provided at its ends. One or more of the side rails 24 can be raised and lowered via the movement assembly 40. At least one of the side rails 24 may include a display 50 for control and/or display of the features of the person support apparatus 10. Foot control pedals 56 may be coupled to the lower frame 12 and allow for raising and lowering the height of the upper frame 16.

In various embodiments, the person support apparatus 10 includes one or more securing straps 62 for securing the person's feet to the footboard 26 adjacent the pressure surface 60 during exercise and/or strength monitoring. The sensor 59 (FIG. 1A) provides a signal indicative of the magnitude of the pressing force incident on the pressure surface 60 of the footboard 26. In some embodiments, the sensor is configured to detect a varying magnitude of the pressing force. In some embodiments, the sensor may be incorporated in the pressure surface 60. For example, the pressure surface 60 may include an integrated load cell sensor such as those that measure weight. However, other force sensing technologies may be used and integrated within the pressure surface 60, such as pressure-sensitive resistors, capacitive force sensors, and piezoelectric transducers. In still other embodiments, the sensor may not be integrated within the pressure surface 60, but is configured to detect the force incident on the footboard 26, such as when the pressure sensor is disposed between the pressure surface 60 and the footboard 26. In still other embodiments, the pressure sensor may be attached to the passive resistance mechanism 42 (FIG. 1D), such as when the pressure sensor is a linear extensometer and/or strain gauge. In these embodiments, the pressure sensor measures the force exerted by the user on the footboard by measuring the displacement and/or strain of the passive resistance mechanism. Information regarding the exercise performed with the footboard 26 may be displayed on the user interface 52. For example, the sensor may provide the signal indicative of the magnitude of the pressing force to a system controller which is communicatively coupled to the sensor and the user interface 52 to cause information to be displayed by the user interface 52.

Figure 7:
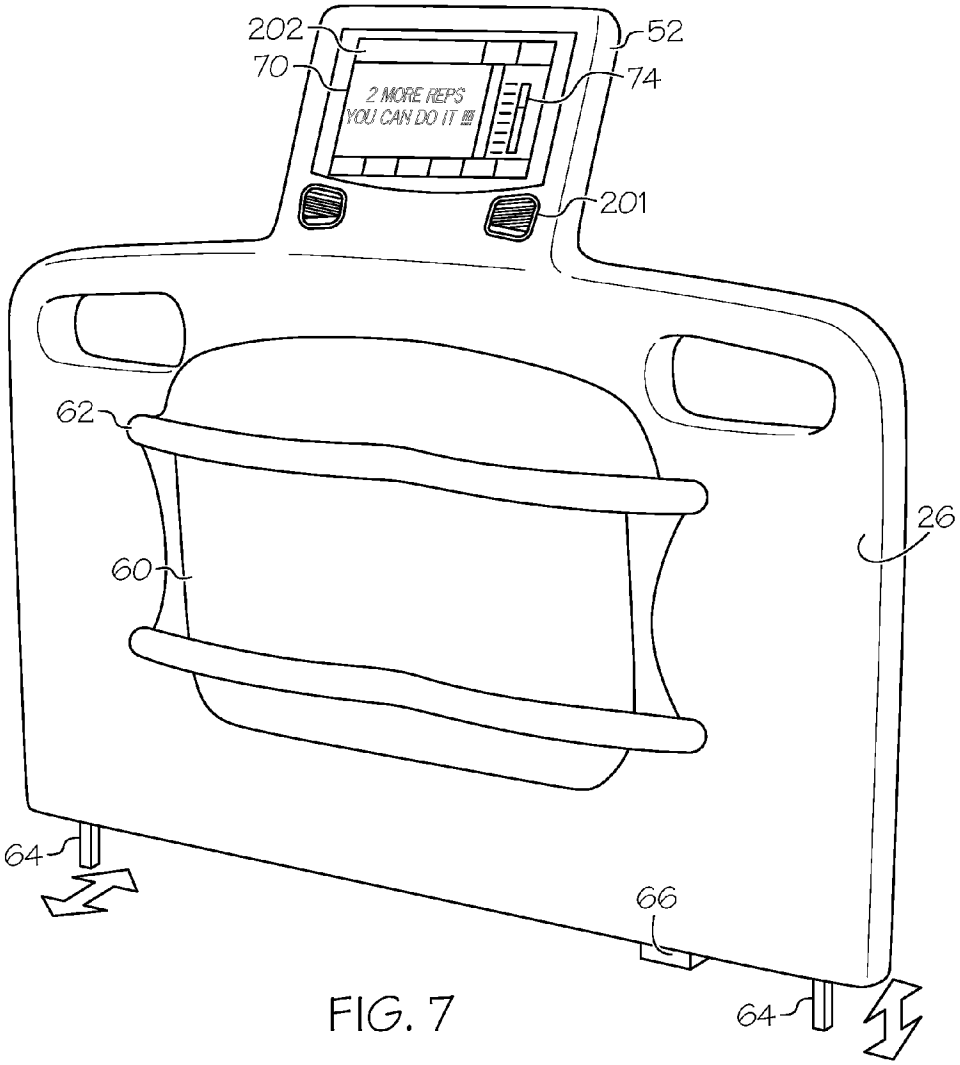
FIG. 7 is a perspective view of a footboard according to one or more embodiments.

Information detected by the sensor may be provided to the system controller in a variety of ways, depending on the particular embodiment. For example, FIG. 7 illustrates one embodiment in which the sensor includes strain gauges. As shown in FIG. 7, the footboard 26 includes one or more pins 64 which couple the footboard 26 to the extendable foot section 36 of the person support apparatus 10. The pins 64 may be strain gauges and/or have strain gauges attached thereto in the form of thin foils disposed within the footboard 26 and/or upper frame 16 (FIG. 5). The pins 64 move the strain gauge foil within the footboard 26 and/or upper frame 16 which modifies the electrical resistance of the foil which, in turn, provides an output signal indicative of the amount of force being exerted by the person on the pressure surface 60. The signal indicative of this force is provided to the control system via electrical connector 66 within the footboard 26. While FIG. 7 depicts one particular embodiment of a sensor which may be used to determine the force exerted on the footboard 26 by a person, it should be understood that other types of sensors may be used as described hereinabove.

In the embodiment illustrated in FIG. 7, the user interface 52 displays on display 202 a motivational message 70 along with a graphical meter 74 indicative of the amount of force being exerted. In some embodiments, the information displayed on the user interface 52 may include the number of exercise repetitions, the exercise time (e.g., how long the person performed exercises with the footboard 26), information regarding exercise force, and/or another type of exercise encouragement. In embodiments, the speaker 201 may be used to provide audible feedback to the person during exercise. For example, the speaker 201 may be used to provide an audible indication of the start and/or end of an exercise interval, the successful completion of one or more reps, audible encouragement, audible instructions, music, or the like.

Referring to FIGS. 5 and 6, one or more grips 63 may extend from the upper frame 16. In embodiments, the grips 63 extend above the support surface and may be positioned over the support surface 18, as depicted in FIG. 5, or may be positioned directly adjacent to the support surface 18. The grips 63 are sized and positioned to be grasped by the person for leverage and/or stability as an exercise is performed on the person support apparatus 10. In some embodiments, at least one of the grips 63 may include a pulse sensor communicatively coupled to the interface 52, such that when the grip is grasped by the person, the person's heart rate is detected and transmitted to the interface 52 and displayed on the user interface 52. In embodiments, position of the grips 63 may be adjustable with respect to the frame 16, such as when the grips 63 are mounted on a rail system (not shown) which is, in turn, attached to the upper frame 16.

Figure 8A:
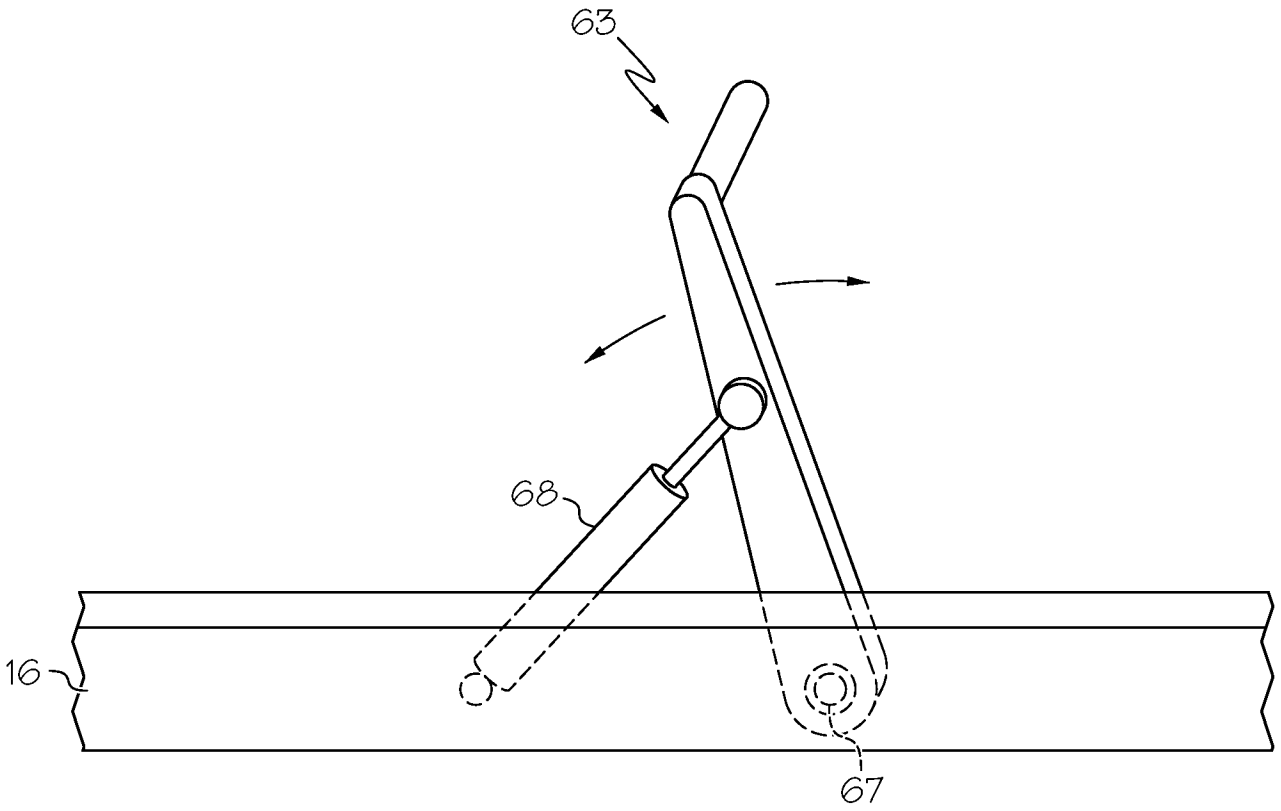
FIG. 8A depicts pivotally mounted grips of a person support apparatus according to one or more embodiments.
Figure 8B:
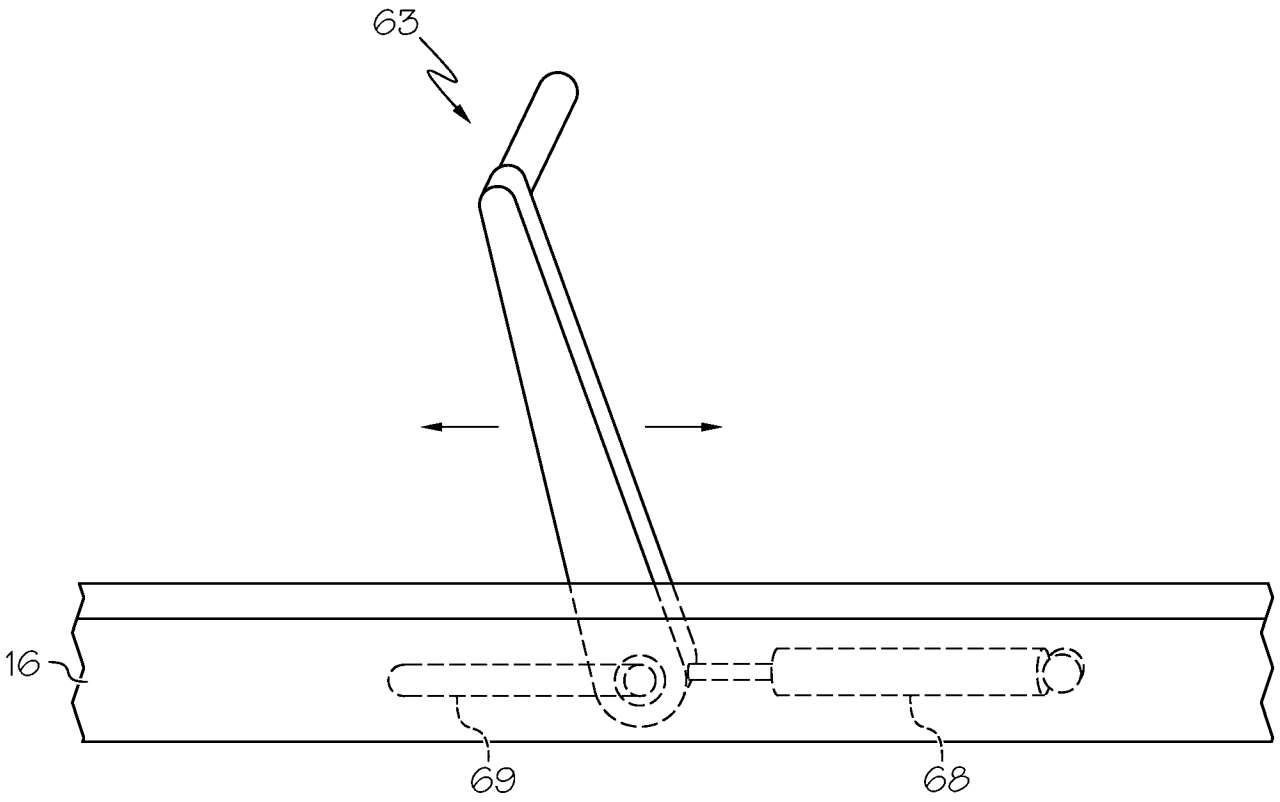
FIG. 8B depicts slidably mounted grips of a person support apparatus according to one or more embodiments.

In some embodiments, the grips 63 may be freely slidable and/or pivotable relative to the upper frame 16 and/or the footboard 26 to facilitate a rowing-type upper body exercise in conjunction with and/or separate from the leg-press exercise performed with the footboard. For example, in the embodiment depicted in FIG. 8A, the grips 63 may be pivotally attached to the upper frame 16 such that the grips are free to rotate with respect to the upper frame about a pivot point 67. In this embodiment, one or more passive grip resistance mechanisms 68, such as air springs, coil springs or the like, may be coupled between the grips 63 and the upper frame 16 to provide passive resistance to the grips 63 as they are rotated either towards and/or away from the footboard 26. In the embodiment depicted in FIG. 8B, the grips 63 may be slidably coupled to the upper frame 16 with a rail system coupled to the upper frame 16 such that the grips 63 are freely slidable within a slot 69 with respect to the upper frame 16. The rail system may further include one or more passive grip resistance mechanisms 68 which provide resistance to the grips 63 as the grips are slid towards and/or away from the footboard 26. For example, the passive grip resistance mechanism 68 may be a piston. In either embodiment, the passive grip resistance mechanism may be selectively lockable in either a free position where the grip is moveable, or a locked position where the grip is locked in place. Accordingly, in some embodiments, the person can either use the grips 63 as leverage or stability, or can move the grips 63 against the resistance of the passive grip resistance mechanism 68 to perform upper body therapy exercises.

Referring now to FIGS. 1A-1D and FIGS. 5-6, the footboard 26 is coupled to the extendable foot section 36 (FIGS. 1A, 1B, & 1D) of the deck 22, and the foot section of the deck 22 is freely slidable with respect to the seat section 34, as described above. Accordingly, the person can move the footboard 26 and the extendable foot section 36 from the retracted position (schematically depicted in FIG. 5) to the extended position (schematically depicted in FIG. 6) by pushing on the pressure surface 60 of the footboard 26 to perform a leg-press type exercise on the person support apparatus 10. As the person exerts force on the footboard 26, the passive resistance mechanism 42 resists the motion of the footboard from the retracted position (FIG. 5) to the extended position (FIG. 6) with a biasing force B. Accordingly, the person can push the pressure surface 60 against the biasing force B of the biasing mechanism into the extended position to perform a leg-press type exercise on the person support apparatus 10.

While the extendable foot section 36 has been described herein as being freely slidable with respect to the seat portion 34 (FIG. 1A), it should be understood that the person support apparatus 10 may further include one or more mechanisms for locking the extendable foot section 36 in place, such as in the neutral position described above. For example, as depicted in FIG. 1B, the extendable foot section 36 can be locked into place, by a pin, actuator, or other locking mechanism. As noted hereinabove, the extendable foot section 36 may include an actuator 35 which can be used to automatically drive the extendable foot section 36 between the extended and retracted positions. In embodiments, the actuator 35 may drive the extendable foot section 36 against the biasing force B of the passive resistance mechanism 42, such as when the passive resistance mechanism 42 remains coupled to the extendable foot section 36 and/or the seat portion 34. Alternatively, the passive resistance mechanism 42 may be decoupled from the extendable foot section 36 and/or the seat portion 34 as the actuator 35 is used to drive the extendable foot section 36. When not actively driving the extendable foot section 36, the actuator 35 maintains the extendable foot section 36 in a static position, locking the extendable foot section 36 in place. To transition the extendable foot section 36 from "locked" to "freely slidable", the actuator 35 may be decoupled from the extendable foot section 36, thereby allowing the extendable foot section 36 to freely slide relative to the seat portion 34 of the deck 22. In embodiments, the actuator 35 may be decoupled from the foot section by, for example, removing a pin 37 which couples the actuator 35 from the extendable foot section 36.

Once the actuator 35 is disengaged from the extendable foot section 36, the person may apply a pressing force to the footboard 26 to extend the extendable foot section 36 and perform an exercise, such as a leg-press type exercise. When the person has completed the exercise or therapy routine, the passive resistance mechanism 42 may be disengaged and the actuator 35 may be reengaged so as to lock the extendable foot section 36 into position.

In some embodiments, a specialized actuator may be used in place of a passive resistance mechanism 42 and separate actuator 35. For example, in some embodiments, an actuator with a built-in resistance release mechanism may be employed in place of the passive resistance mechanism 42 and the actuator 35. Specifically, an actuator with a release mechanism that provides a set resistance upon release may be coupled to the extendable foot section 36 and footboard 26. For example, the actuator may have a first state in which the actuator may be used to actively drive the extendable foot section 36 between the extended position and the retracted position. Once a desired position is obtained, the release mechanism of the actuator may transition the actuator from the first state where the actuator is an actively driven actuator to a second state where the actuator acts as a passive resistance mechanism and allows the extendable foot section to be freely slidable with respect to the seat section 34 of the deck 22. For example, a suitable actuator with a first state and a second state may include, without limitation, a standard linear actuator having a spring (gas or linear) mounted in parallel with the screw of the actuator and a mechanical clutch to decouple the screw from the motor. Accordingly, when the mechanical clutch decouples the screw from the motor, the spring may provide a set amount of passive resistance.

In the embodiment shown in FIGS. 1A-1D and FIGS. 5 and 6, the footboard 26 is coupled to an extendable foot section of the deck 22. However, in alternative embodiments, the footboard 26 may be freely slidable with respect to the upper frame 16 while the foot section of the deck 22 does not move with respect to the seat portion 34.

Figure 28A:
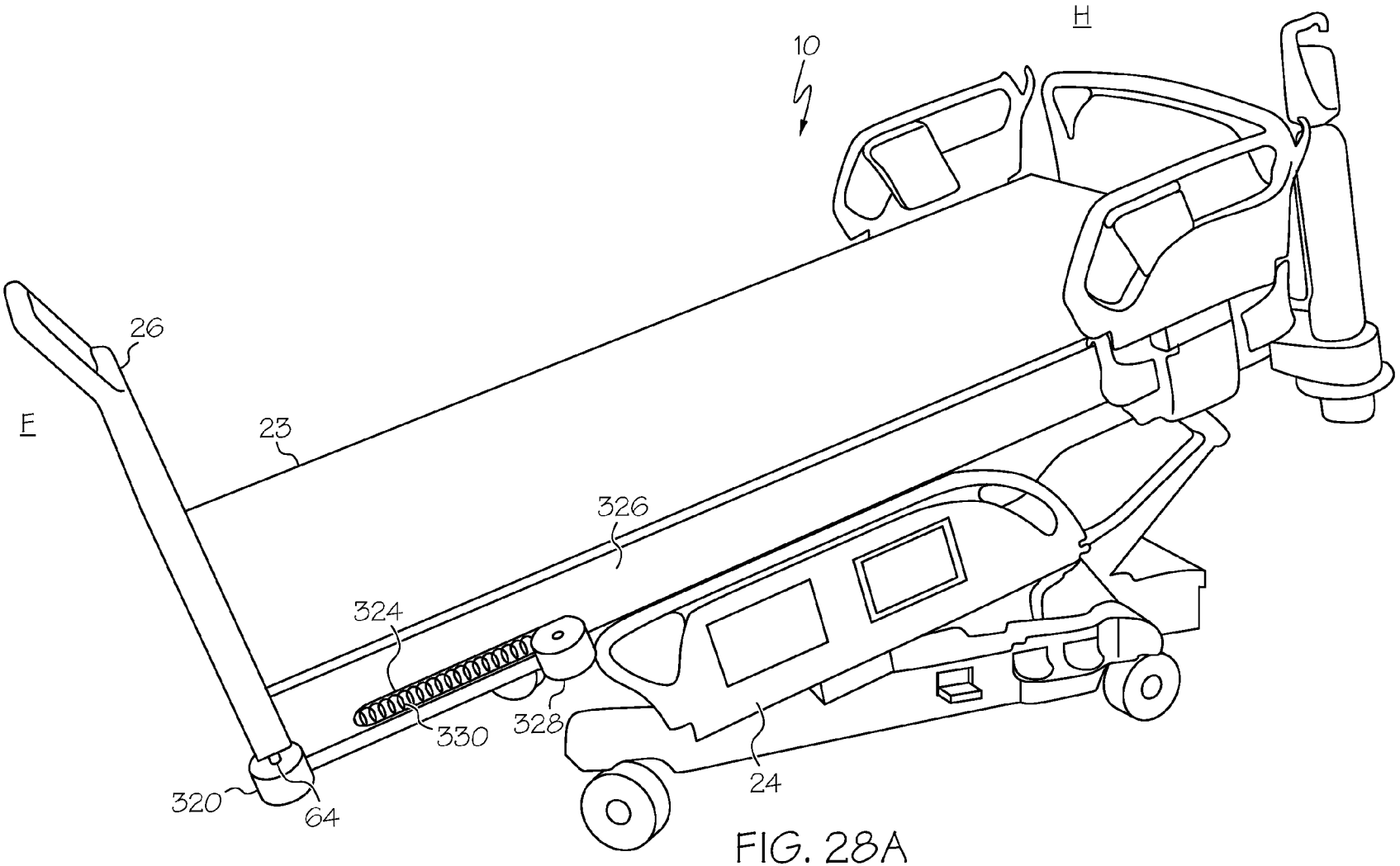
FIGS. 28A and 28B depict a person support apparatus with a footboard repositionable from a fixed position (FIG. 28A) to an exercise position (FIG. 28B) wherein the footboard is slidable relative to the mattress.
Figure 28B:
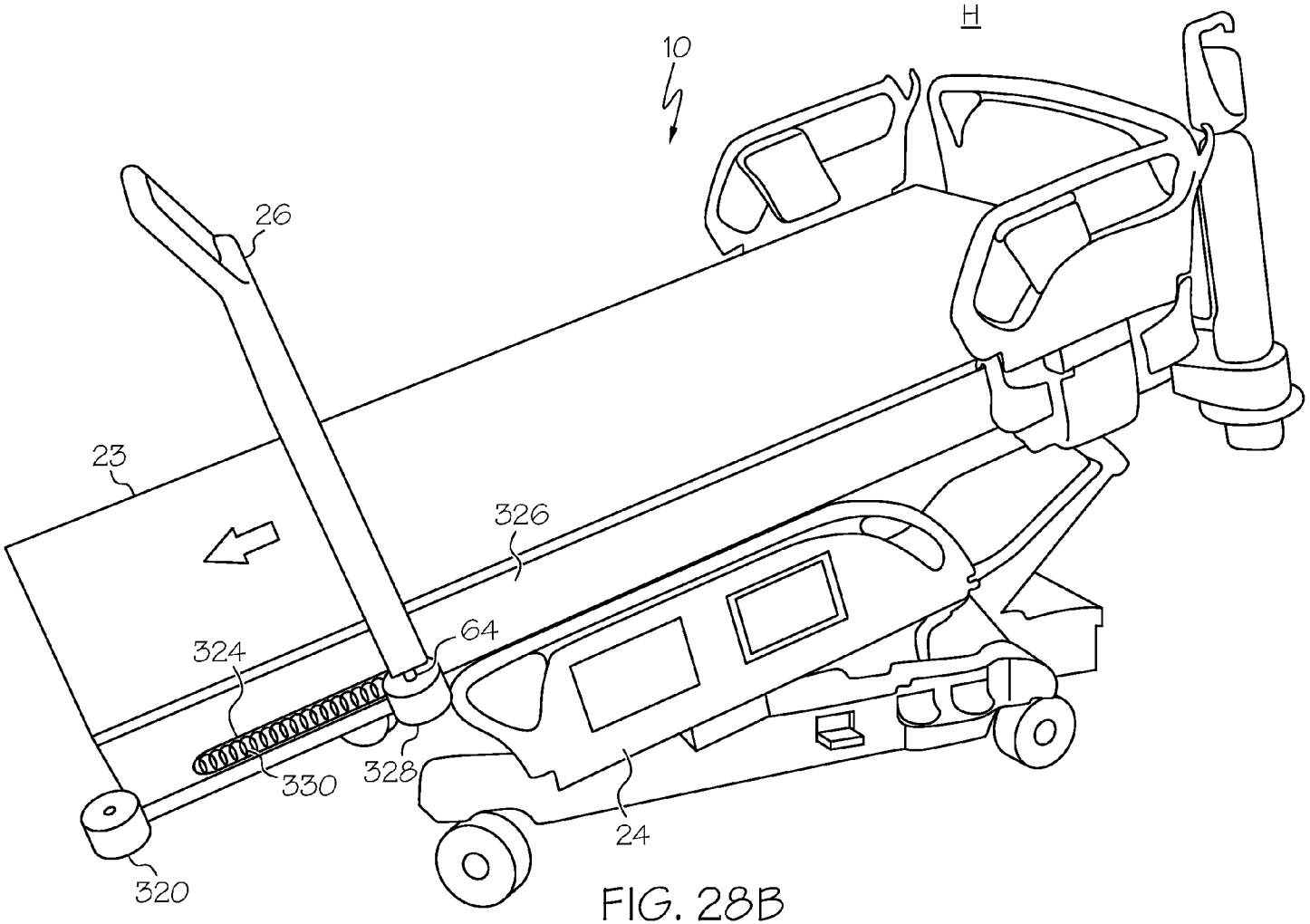

Referring to FIGS. 28A and 28B by way of example, in this embodiment the person support apparatus 10 comprises a footboard 26 which may be removably positioned in fixed support brackets 320 (one depicted in FIGS. 28A and 28B) coupled to a rail 326 attached to the upper frame of the person support apparatus 10. The rail 326 may also include a pair of sliding support brackets 328 (one depicted in FIGS. 28A and 28B). The sliding support brackets 328 may be positioned in a slot 324 formed in the rail 326 such that the sliding support brackets are freely slidable with respect to the rail 326. A passive resistance mechanism, which is a compression spring 330 in the embodiment depicted, may be disposed in the slot 324 and coupled to the sliding support bracket 328, thereby providing resistance to the sliding support brackets 328 as the sliding support brackets are translated towards a foot end F of the person support apparatus 10. While FIGS. 28A and 28B depict the passive resistance mechanism as a compression spring 330, it should be understood that other, similar passive resistance mechanisms may be used, including, without limitation, air springs or the like.

In use, the footboard 26 may have a first, fixed position where the footboard 26 is removably coupled to the fixed support bracket 320 with, for example, pins 64 received in a corresponding aperture formed in the fixed support bracket. In this first, fixed position the footboard has a conventional orientation and function with respect to the person support apparatus 10. To facilitate exercising with the person support apparatus 10, the footboard 26 may be removed from the fixed support brackets 320 and repositioned in the sliding support brackets 328, thereby assuming a second, exercise position as depicted in FIG. 28B. When in the exercise position (i.e., the retracted position), a person positioned on the mattress 23 of the person support apparatus 10 may press against the footboard 26 to perform a leg-press type exercise. As the person exerts force against the footboard 26 with his or her feet, the footboard 26 and corresponding sliding support brackets 328 slide/translate to an extended position proximate the foot end F of the person support apparatus 10. As the footboard 26 translates, the compression spring 330 exerts a biasing force towards the head end H of the person support apparatus, thereby providing resistance to the person performing the leg-press type exercise. Accordingly, it should be understood that, in these embodiments, the footboard 26 is removably coupled to the patient support apparatus 10 and has a fixed orientation and an exercise orientation wherein the footboard is slidable/translatable with respect to the mattress and/or upper frame of the person support apparatus 10.

Lateral Bar for Leg Lifts and Curls

In various embodiments, the person support apparatus 10 may include a physical therapy bar and a passive resistance mechanism as part of a leg lift physical therapy system. The physical therapy bar is moveable against a force provided by the passive resistance mechanism. One such system is depicted in FIG. 9.

Figure 9:
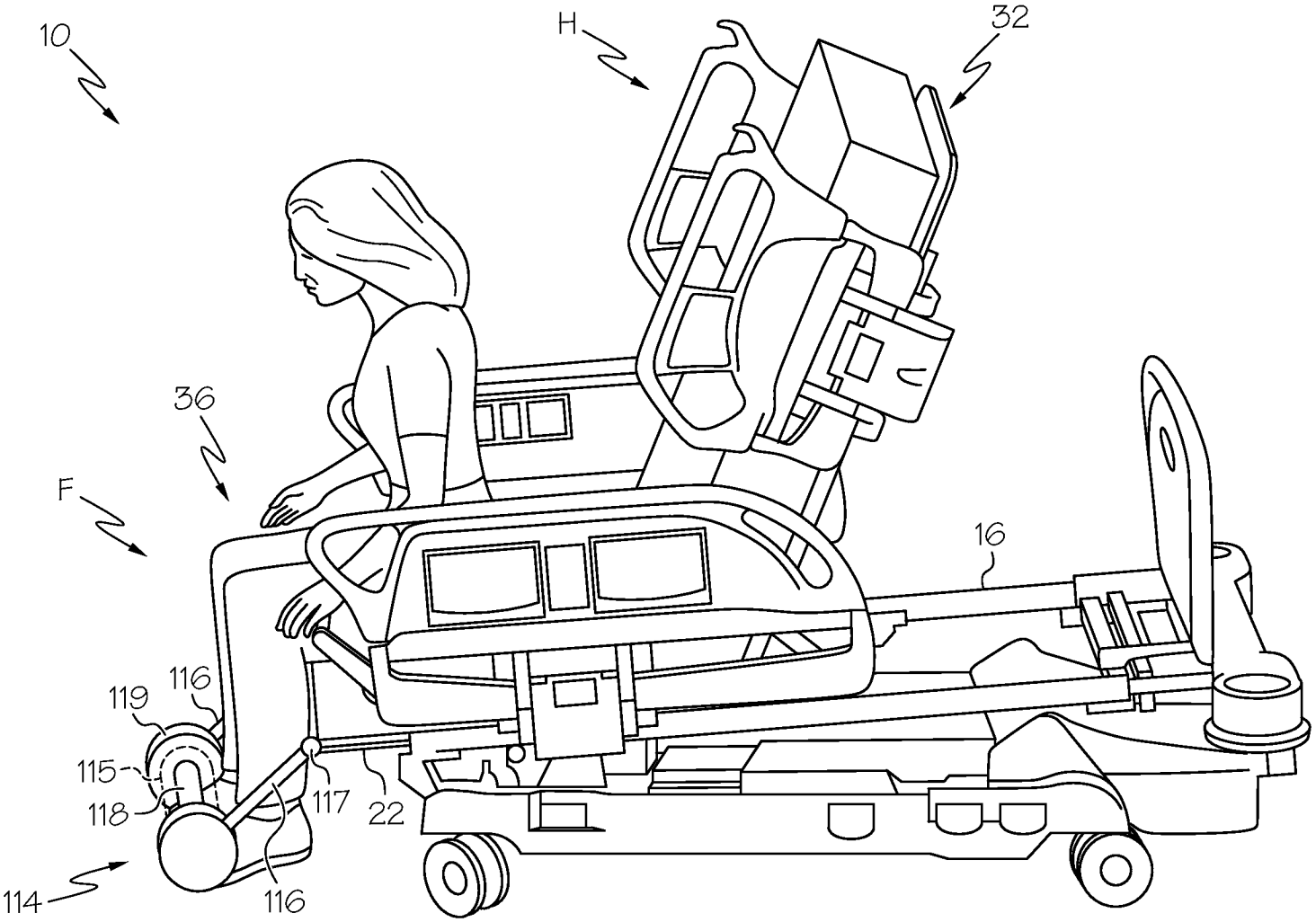
FIG. 9 depicts a person support apparatus including a lateral bar near the foot end of the person support apparatus according to one or more embodiments.

FIG. 9 depicts an embodiment of a person support apparatus 10 having a leg lift physical therapy system 114 located at the foot end of the person support apparatus 10. In this embodiment, the footboard (not shown) is detachable from the foot end F of the person support apparatus 10. The leg lift physical therapy system 114 includes a pair of longitudinal links 116 which are pivotally coupled to the support deck 22 and/or upper frame 16 of the person support apparatus 10 with pivots 117. The longitudinal links 116 are rigidly connected to one another with a lateral bar 118. In some embodiments, a pad 115 may be placed around the lateral bar 118 to provide greater comfort to the person when the lateral bar 118 is engaged with the lower legs and/or feet of the person. In one embodiment, one or more weights 119 may be positioned at the ends of the lateral bar 118 to provide resistance as the person pivots the leg lift physical therapy system 114 about the pivots 117.

To utilize the leg lift physical therapy system 114 shown in FIG. 9, the footboard of the person support apparatus 10 is first removed and then the person support apparatus 10 is reconfigured to a chair-like position by pivoting the head portion 32 relative to the upper frame 16. With the person support apparatus 10 configured in this orientation, the person can be positioned on the person support apparatus 10 in a seated position with the lower legs and feet beneath the lateral bar 118. The person then extends the legs upwardly, straightening the leg at the knee, to perform physical therapy using the leg lift physical therapy system 114. The person can perform strengthening physical therapy to strengthen the legs and/or aerobic physical therapy, by pushing the lateral bar 118 upwardly.

Figure 10:
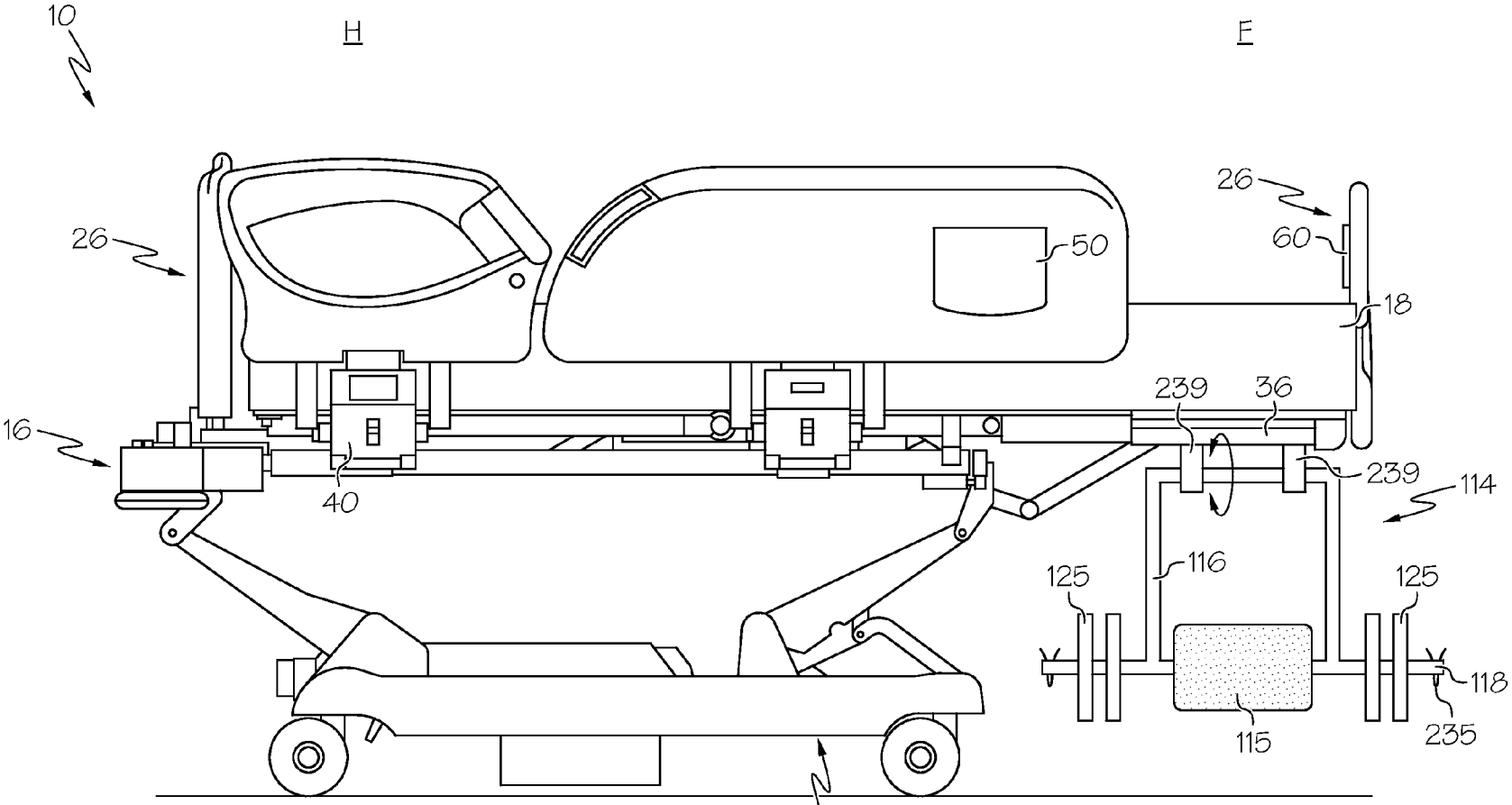
FIG. 10 depicts a person support apparatus including a lateral bar along the side of the person support apparatus according to one or more embodiments.

Referring now to FIG. 10, in some embodiments, the leg lift physical therapy system 114 may be used by a person sitting on the side of the person support apparatus 10. As in the previous embodiment, the leg lift physical therapy system 114 includes a lateral bar 118 that holds weights 125 that are secured to the lateral bar 118 with pins 235. A pair of longitudinal links 116 is connected to the lateral bar 118 and engages with pivots 239 which are connected to the upper frame 16 underneath the foot section 36 of the deck 22 of the person support apparatus 10. The pivots 239 facilitate pivoting the lateral bar 118 and longitudinal links 116 with respect to the upper frame 16. In this embodiment, the person may sit proximate the foot end F of the person support apparatus 10, with feet hanging off one side of the person support apparatus 10 and positioned behind the lateral bar 118. In some embodiments, a pad 115 surrounds the lateral bar 118 to provide a cushion for the user. The user may straighten his or her legs at the knee, thereby pushing on the lateral bar and pivoting the lateral bar 118 outwardly from the person support apparatus 10 against the resistance of the weights 125. The longitudinal links 116 rotate within the pivots 239 allowing the lateral bar 118 to swing back and forth during the physical therapy. When not in use, the lateral bar 118 may be rotated upwardly to a stowed position underneath the foot section 36, where it may be latched into place. Accordingly, in this embodiment, the leg lift physical therapy system 114 can be stored underneath the person support apparatus 10 when not in use without requiring any additional storage space.

In some embodiments, the lateral bar 118 may be configured to enable the person to perform leg curls. For example, the lateral bar 118 can be coupled to the passive resistance mechanism such that the person pushes down on the lateral bar 118 with the backs of the legs in order to overcome the resistance. In such embodiments, the lateral bar 118 may be located at or near the foot end F of the person support apparatus 10 or along the side of the person support apparatus 10.

Foot Pedals

In various embodiments, one or more foot pedals 92 may be provided to enable the person to perform one or more exercises, such as a single or double leg-press type exercise, using the person support apparatus 10. As will be described in detail below, the foot pedals 92 may be integrated in and/or supported by the side rail 24, the footboard 26, or another part of the person support apparatus 10 described above. The foot pedals 92 may be included in a person support apparatus 10 that includes one or more additional physical therapy features, including but not limited to, the lateral bar 118, the extendable foot section 36, and/or the moveable footboard 26 described above.

Figure 11:
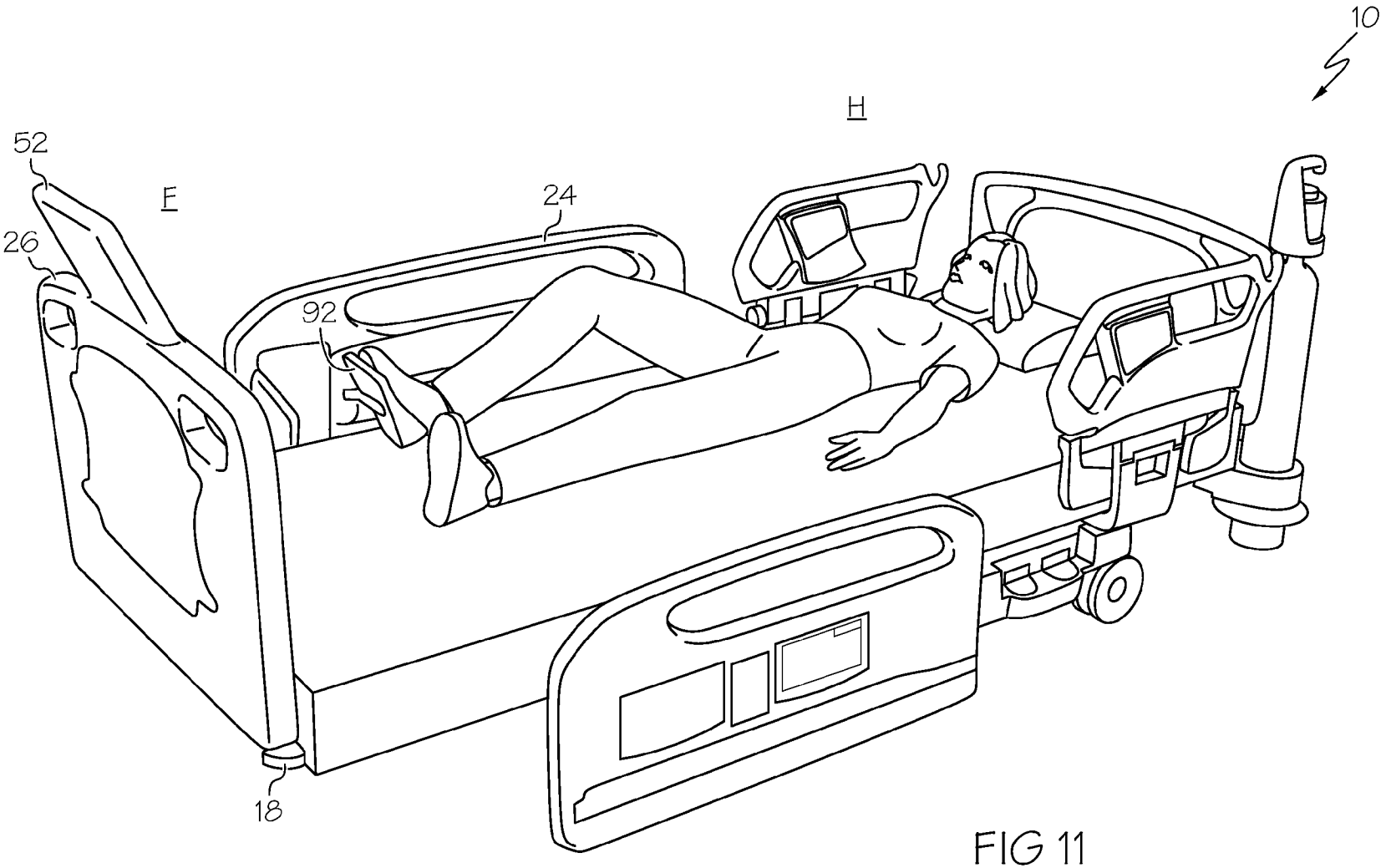
FIG. 11 is a perspective view of a person support apparatus having a pedal extending from a side rail according to one or more embodiments.

FIG. 11 depicts one embodiment of a person support apparatus 10 which includes a pedal 92 extending from the side rail 24. In this embodiment, the pedal 92 may be located closer to the foot end F of the person support apparatus 10 than the head end H. In this embodiment, the pedal 92 is slidingly engaged with the side rail 24, so as to allow the pedal 92 to be moved between the foot end F and the head end H by the person. Accordingly, it should be understood that the foot pedal 92 is freely slidable with respect to the support surface 18 from a retracted position wherein the foot pedal is furthest from the foot end F to an extended position wherein the foot pedal is closest to the foot end F.

Figure 12:
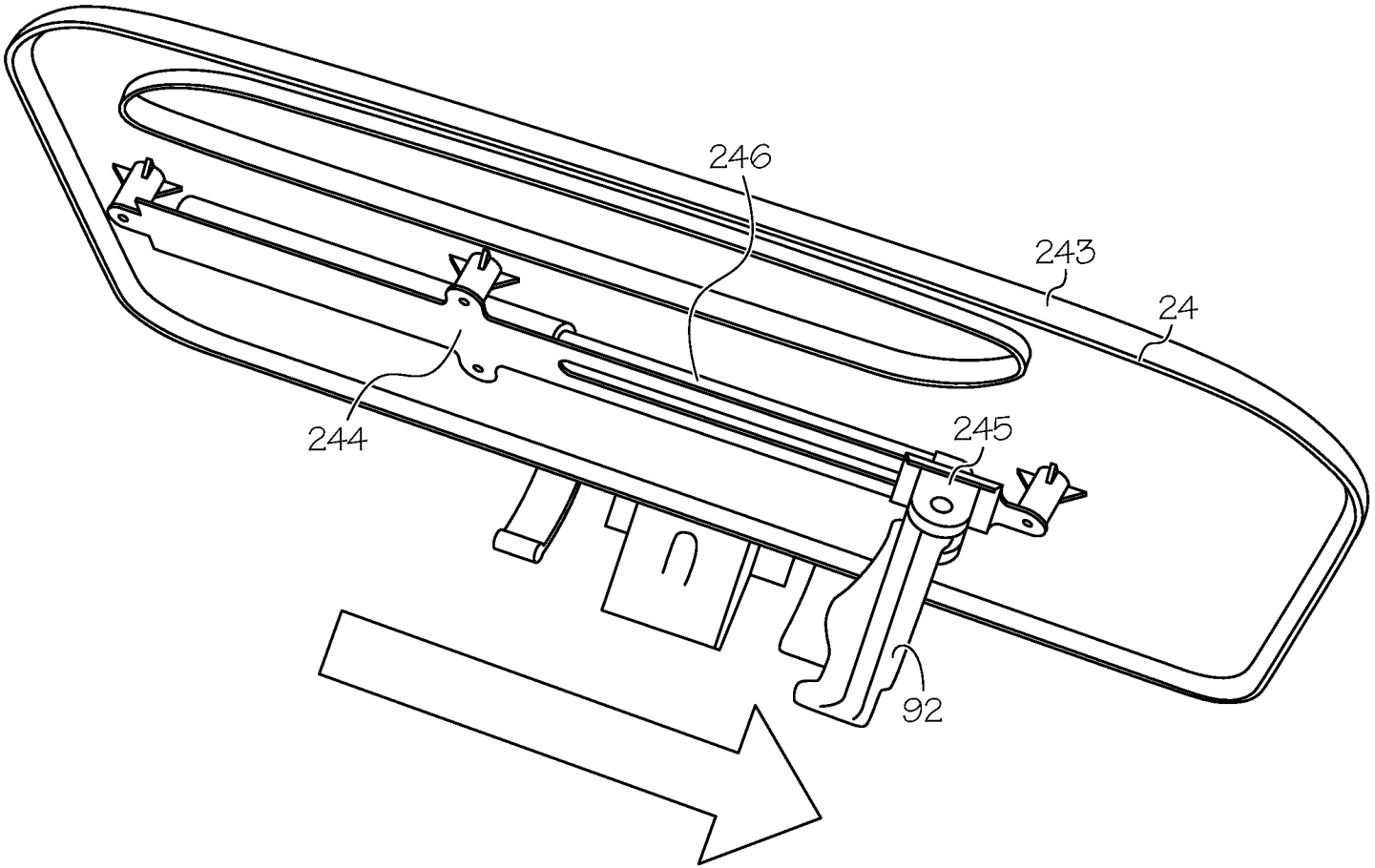
FIG. 12 is a perspective view of the side rail of FIG. 11, with half of the side rail housing removed according to one or more embodiments.
Figure 13:
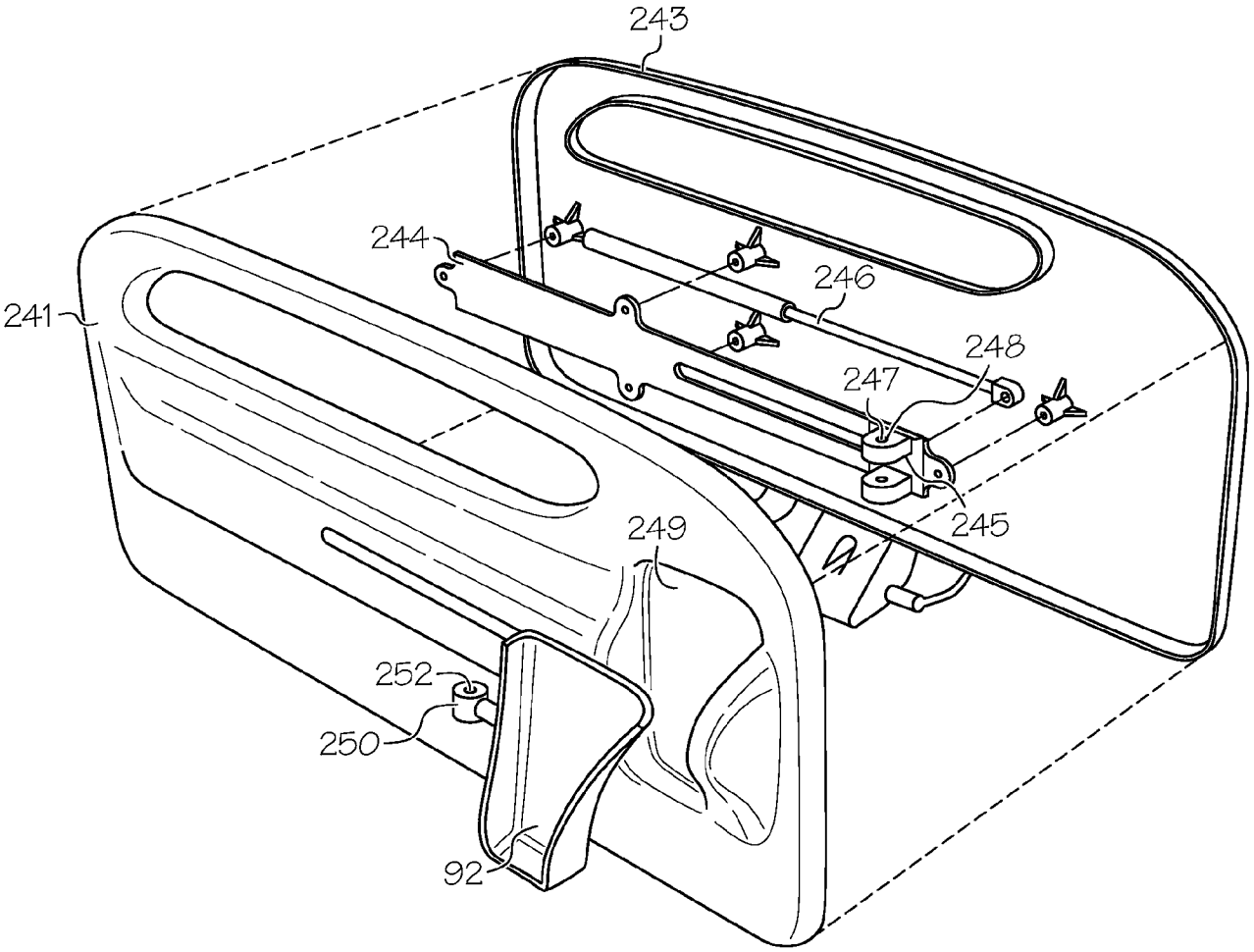
FIG. 13 is an exploded perspective view of the side rail of FIG. 11 according to one or more embodiments.

FIGS. 12-13 depict an assembly view of one embodiment of the side rail 24. As shown in FIGS. 12-13, the pedal 92 is pivotally attached to a coupling 245 which is slidingly engaged within a guide frame in the form of a track 244 disposed between the inner housing portion 241 and the outer housing portion 243. A passive resistance mechanism 246 is disposed within the inner housing portion 241 and the outer housing portion 243 and attached to the coupling 245. In the embodiment shown in FIGS. 11 and 12, the passive resistance mechanism 246 is a gas spring. However, it should be understood that other suitable passive resistance mechanisms may be used including, without limitation, coil springs, elastic bands, or the like. Accordingly, it should be understood that the pedal 92 is linked to the passive resistance mechanism 246 through the coupling 245 such that the motion of the pedal 92 is resisted in at least the direction of the foot end F of the person support apparatus 10.

When the passive resistance mechanism 246 is a gas spring as shown in FIGS. 12 and 13, pressing the pedal 92 towards the foot end F of the person support apparatus 10 with sufficient force moves an inner tube of the gas spring within an outer tube of the gas spring 246 against the internal resistance provided by the gas spring, which is manifested as a biasing force B. As the pedal 92 is pressed, the coupling 245 moves within the inner housing portion 241 and the outer housing portion 243 and is guided by the track 244. This passive resistance mechanism allows a person to perform strength training exercises, rehabilitation exercises, diagnostic exercises, and/or therapeutic exercises while positioned in the person support apparatus.

Still referring to FIGS. 11-13, the coupling 245 includes an aperture 247 which defines an axis 248. The pedal 92 likewise includes a corresponding aperture 252 which is used to pivotally couple the pedal 92 to the coupling 245 with a pin (not shown). Accordingly, the pedal 92 can rotated on the axis 248 when attached to the coupling 245. This allows the pedal 92 to be rotated to a stowed position wherein the pedal 92 is positioned in a storage recess 249 formed in the inner housing portion 241 of the side rail 24. In embodiments, pedal 92 may further include a locking pin such that the pedal 92 can be locked in the deployed position (i.e., extending from the side rail). The pin may be withdrawn to unlock the pedal and later reinserted once the pedal 92 is rotated to the stowed position wherein the pedal 92 rests in the storage recess 249 formed in the inner housing portion 241 of the side rail 24.

Referring again to FIG. 11, in this embodiment, a person seated on the support surface 18 places a foot against the pedal 92 in the deployed position and repeatedly moves the pedal back and forth against the resistance provided by the passive resistance mechanism to perform either a single or double leg-press type exercise. In some embodiments, the pedals 92 may include a sensor (not shown) that senses the force applied to the pedals 92 by the person. The received information can be transmitted to and displayed on the user interface 52.

Figure 14:
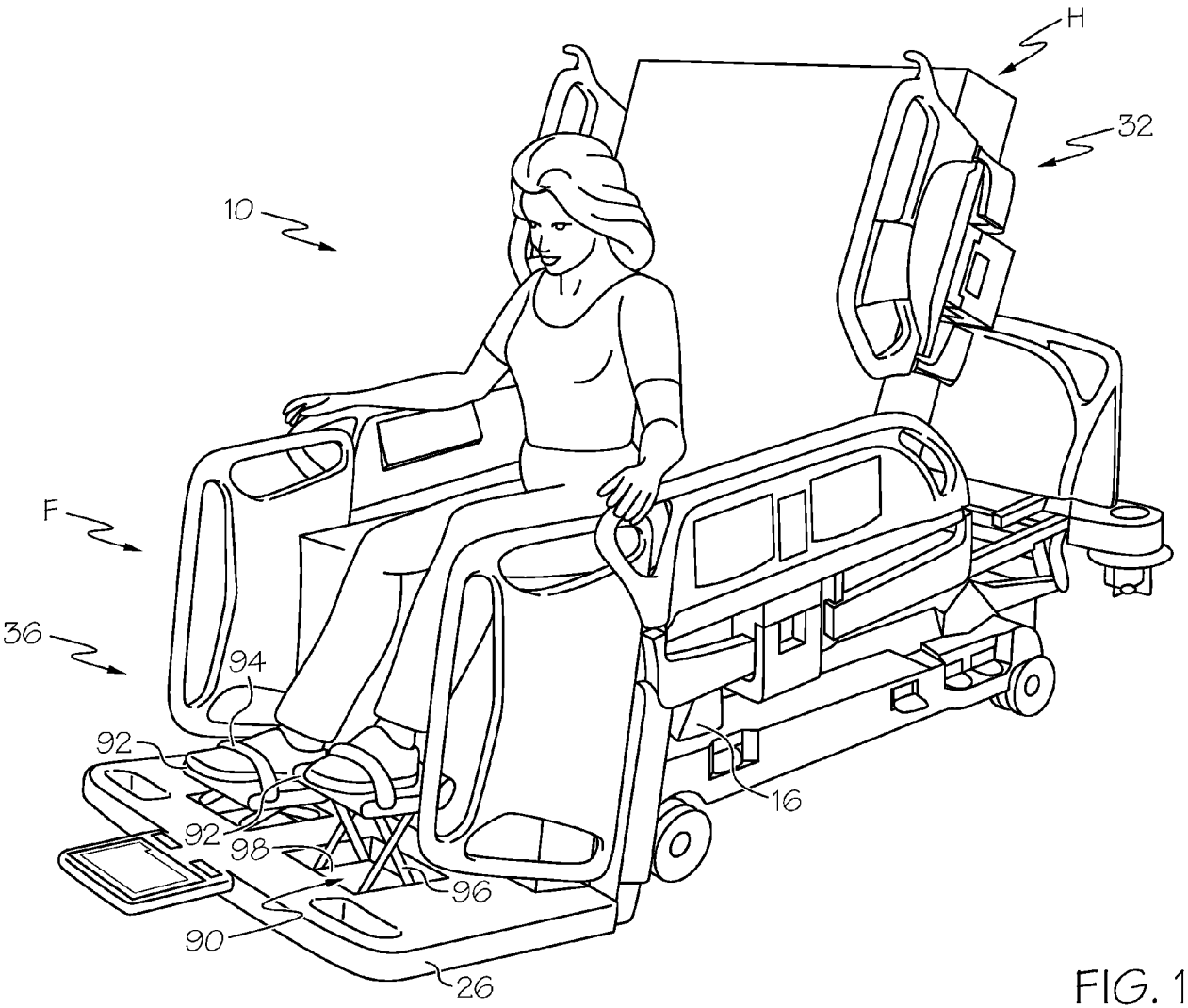
FIG. 14 depicts a person support apparatus having pedals extending from the footboard using a scissors link mechanism according to one or more embodiments.

Referring now to FIG. 14, another embodiment of a person support apparatus 10 with foot pedals 92 is depicted. In this embodiment, the foot pedals 92 are coupled to the footboard 26 and, as such, are indirectly supported by the upper frame 16. In the embodiment of the person support apparatus 10 depicted in FIG. 14, the pedals 92 extend from the footboard 26 away from the foot end F of the person support apparatus 10 and toward the head end H of the person support apparatus 10. In some embodiments, the pedals 92 may include straps 94 which may be used to secure a person's feet to the pedals 92. Each pedal 92 is connected to the footboard 26 with a scissors lift system 96. The scissors lift systems 96 include a pair of spring-biased scissors lifts having a pair of cross linkages which engage with and slide relative to the underside of the pedals 92. The opposite end of each linkage engages with and slides relative to a corresponding recess 98 formed in the footboard 26. The scissors lift systems 96 raise or lower each pedal relative to the recess depending on the amount of force exerted on the pedal by a person's foot. The scissors lift systems 96 are biased to a raised position with a spring coupled to at least one of the cross linkages on each pedal. However, a user may force each pedal 92 downwards, towards the recess 98, against the passive resistance provided by the combination of the spring and the cross linkages, thereby facilitating a single or double leg-press type exercise.

In practice, the pedals 92 may be used to perform a leg-press type exercise by first orienting the person support apparatus 10 in a chair-like position as depicted in FIG. 14 by pivoting the head portion 32 upwardly, and pivoting the foot section 36 and the connected footboard 26 downwardly. In this position, the footboard 26 may be in a nearly horizontal position. The pedals 92 are then deployed from the footboard 26 such that each pedal is in a raised position with respect to the footboard 26. Once a user engages his or her feet with the respective pedals, the user pushes down on the foot pedals 92 to perform exercise against the resistance provided by the springs and cross linkages associated with each pedal 92. In some embodiments, after the exercise is completed, the pedals 92 can be pushed down into the recesses 98 and latched such that each pedal 92 is substantially flush with the surface of the footboard 26, thereby storing the pedals.

While FIG. 14 depicts the person support apparatus 10 configured in a chair-like orientation, it should be understood that a similar leg-press type exercise may be performed with the person support apparatus 10 configured in a bed orientation (i.e., where the foot section, seat portion, and head portion are substantially coplanar).

Figure 15:
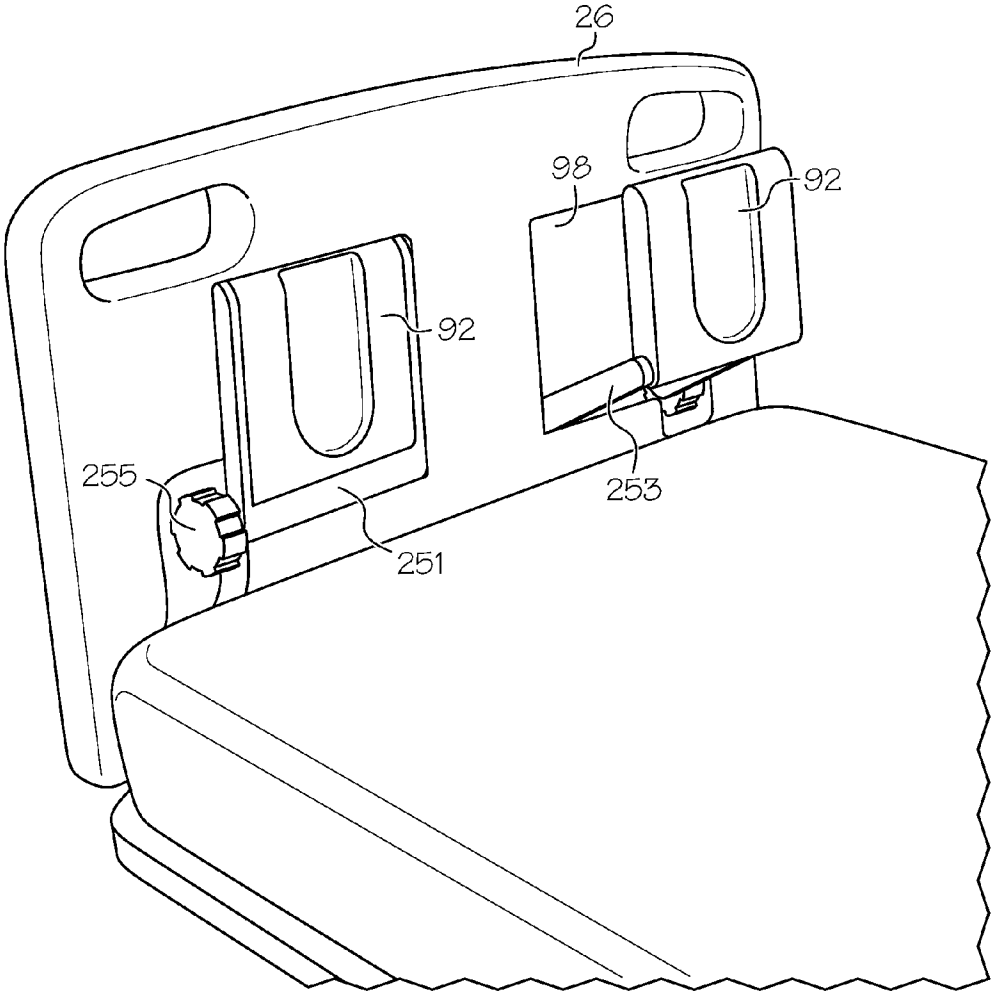
FIG. 15 depicts a person support apparatus having pedals extending from the footboard and stowable within the footboard according to one or more embodiments.

Another embodiment of a person support apparatus with a footboard 26 having pedals 92 is depicted in FIG. 15. In this embodiment, the pedals 92 are coupled to the footboard 26 with frames 251. The pedals 92 pivot about a rod at an end 253 of the frame 251. The pivoting of the pedals 92 is resisted by a resistance mechanism, such as a biasing mechanism (not shown) internal to the assembly and coupled with the rod (which in this embodiment is a torsion spring or spring hinge). A knob 255 allows the frame 251 to be adjustably positioned relative to the footboard 26 and locked into the desired position. For storage, the frame 251 can be placed into the fully upright position and the knob 255 tightened to keep it in that position. The pedals 92 may be rotated downwardly so as to fit within the storage recess 98 formed within the footboard 26. In this embodiment, the person places the foot against the pedal 92 when in the deployed position and pushes repeatedly back and forth against and with the resistance of the biasing mechanism (spring hinge in this example).

Figure 16:
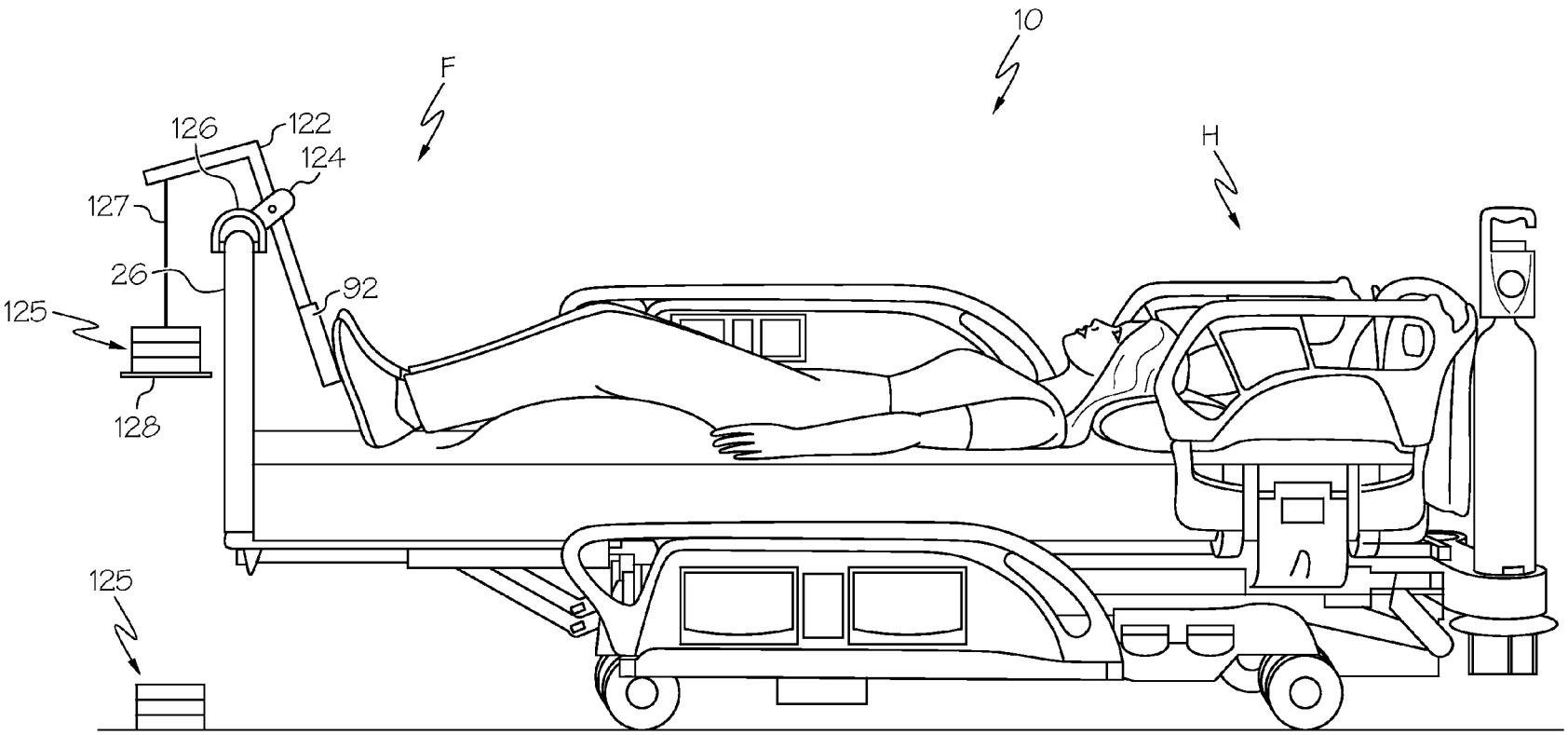
FIG. 16 depicts a person support apparatus having pedals extending from a rocker bar coupled to the footboard according to one or more embodiments.

Referring now to FIG. 16, another embodiment of a person support apparatus with a footboard 26 having a pedal 92 is depicted. In this embodiment, the person support apparatus 10 includes a pedal 92 on a rocker bar 122, located at the foot end of the person support apparatus 10. The rocker bar 122 is held to the footboard 26 with a clamp 126 having a pivot bracket 124. The rocker bar 122 is coupled to the pivoting bracket 124 via a pin extending through the pivot bracket 124 and the rocker bar 122. Attached to the end of the rocker bar 122 is a cable 127 having a removable base plate 128. Weights may be supported by the base plate 128 on the cable 127 by running the cable 127 through an aperture in each of the weights 125 and securing the base plate 128 to the cable 127.

In operation, the person may perform a leg-press type exercise by pressing one or both feet against the pedal 92 of the rocker bar 122, thereby pivoting the rocker bar 122 with respect to the pivot bracket 124 against the resistance provided by the weights 125. The resistance may be varied by removing or adding weights 125 to the base plate 128.

As an alternative to the rocker bar 122 and pivot bracket 124, the cable 127 may be directed through a pulley on the clamp 126 which is then connected with a handle in which the feet are placed.

Figure 17:
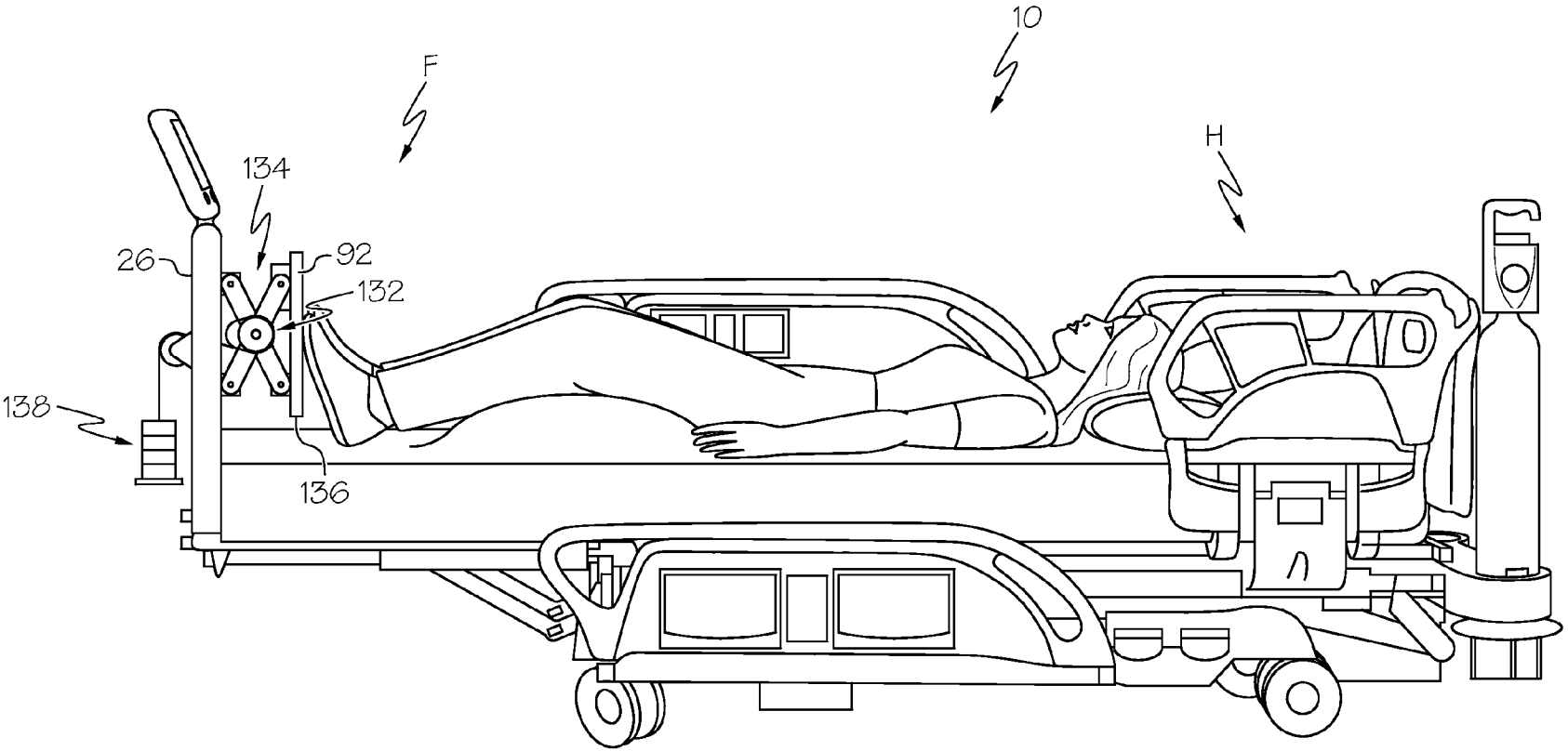
FIG. 17 depicts a person support apparatus having a pedal extend from the footboard according to one or more embodiments.

FIG. 17 illustrates another embodiment of a person support apparatus 10 having foot pedals 92 coupled to the footboard 26 with a scissors link mechanism 134. In this embodiment, the foot pedal 92 is in the form of a foot pad 136 connected to, and movable relative to, the footboard 26, via the scissors link mechanism 134. The scissors link mechanism 134 includes a biasing mechanism that biases the foot pedals toward the head end H of the support surface. The biasing mechanism can be, for example, a spring or the like, coupled between links of the scissors link mechanism 134. The scissors link mechanism 134 may also include a cam 132 that is located at the center of the scissors link mechanism 134 and is connected to a passive resistance mechanism 138, such as a coil spring, air spring or the like, via a cable that passes through an aperture in the footboard 26. Pushing on the foot pad 136 causes the scissors link mechanism 134 to compress, transitioning the foot pad 136 closer to the footboard 26. During this movement, the cam 132 rotates and winds the cable expanding the passive resistance mechanism 138, and providing resistance to the foot pad 136. The cam 132 provides variable resistance to the foot pad 136 and initially assists the person in pushing at the outset of the physical therapy movement with increasing resistance throughout the movement. The cam 132 may also initially offset the resistance provided by the passive resistance mechanism 138.

Figure 18:
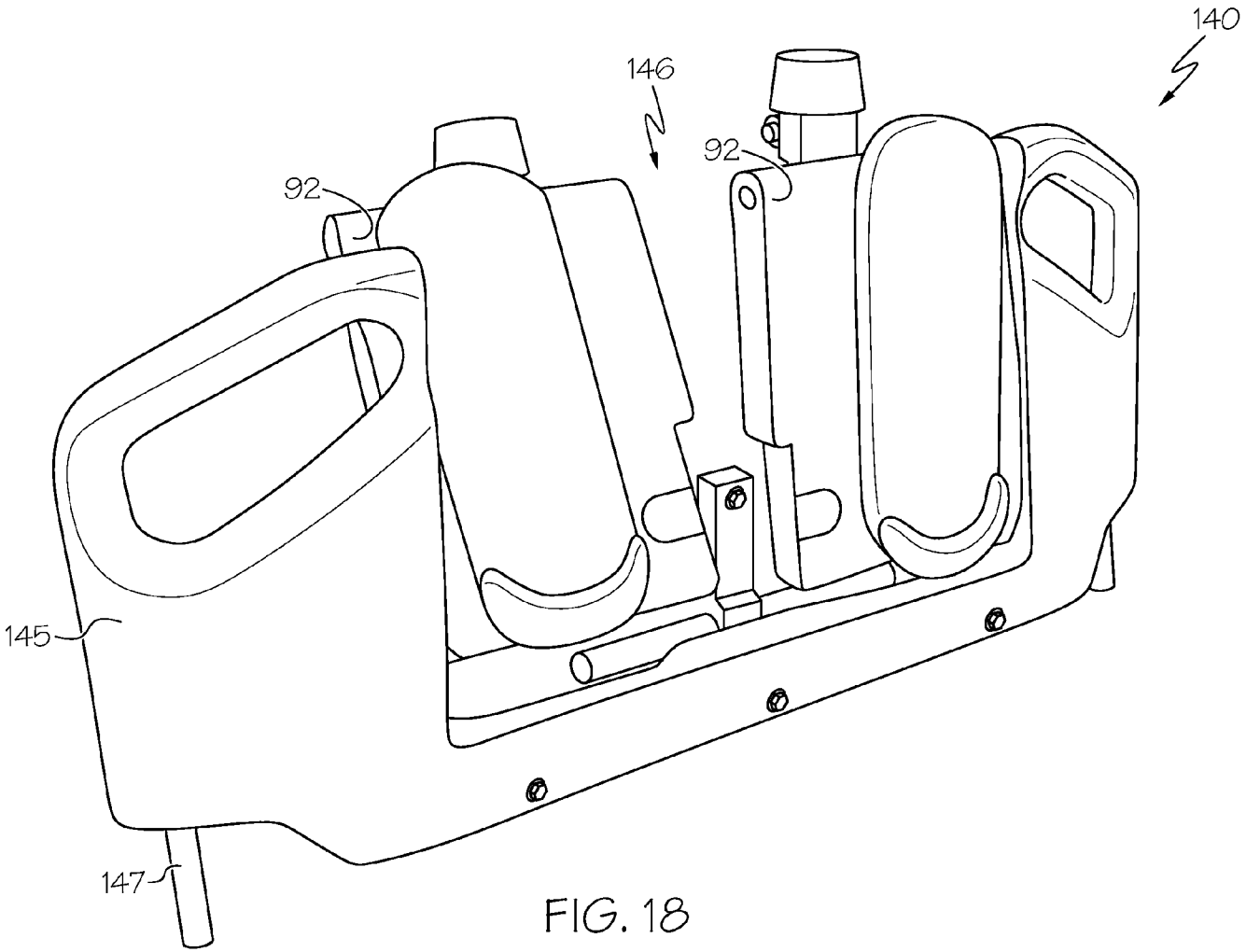
FIG. 18 depicts pedals forming a portion of the footboard according to one or more embodiments.
Figure 19:
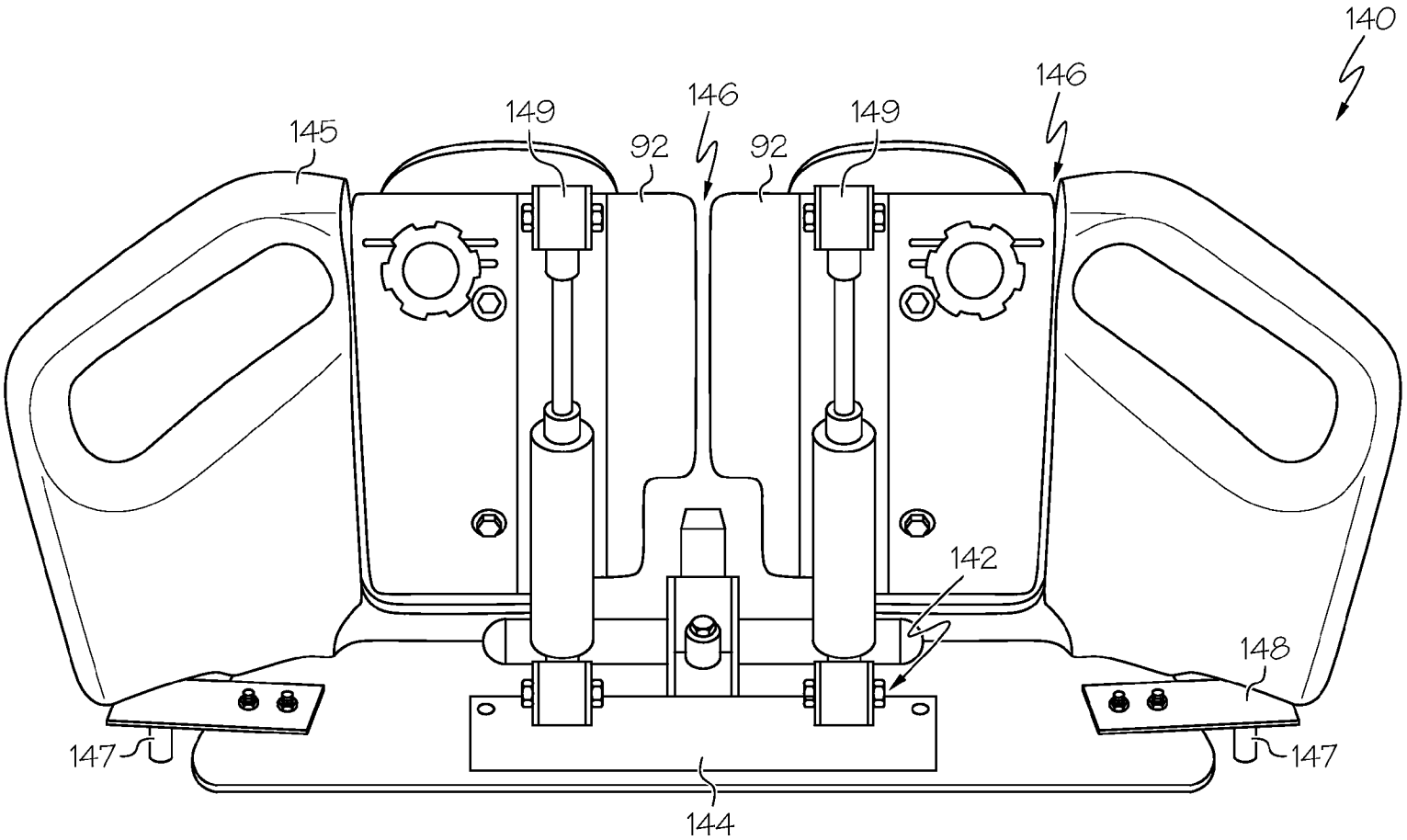
FIG. 19 depicts a bottom view of the pedals depicted in FIG. 18.

FIGS. 18 and 19 depict another embodiment of a footboard 140 of a person support apparatus. In this embodiment, the footboard 140 includes multiple foot pedals 92 integrated within the footboard 140. The footboard 140 may be attached to the person support apparatuses described herein as an alternative to the footboard 26 in various embodiments described above and below. In this embodiment, the footboard 140 acts as a frame in which the foot pedals 92 are pivotally attached. The footboard 140 generally includes a base portion 145 having pins 147 that interface with corresponding mounting holes in the person support apparatus to secure the footboard 140 to the person support apparatus. The base portion 145 of the footboard 140 includes at least one cutout 146 in which the foot pedals 92 are positioned. The foot pedals 92 may be pivotally attached to the base 145 with a hinge 142, which, as shown in FIG. 19, is mounted to a platform 144 which is attached to the base 145 with a connection bracket 148. Accordingly, the foot pedals 92 may pivot relative to the base 145, in and out of the plane defined by the base. The foot pedals 92 may also be positioned such that they are generally aligned with and in the plane of the base 145, such as when the foot pedals 92 are in the upright/nonpivoted position as depicted in FIG. 19. With the foot pedals 92 in this orientation, the footboard 140 has a conventional, planar configuration.

Referring to FIG. 19, each foot pedal 92 is connected to a passive resistance mechanism 149. In the embodiment depicted, the passive resistance mechanism 149 is a gas spring, which is mounted to the pedals 92 and the platform 144. Accordingly, movement of each pedal 92 in and out of the plane of the footboard 140 is resisted by the passive resistance mechanism 149. While the passive resistance mechanism depicted in FIG. 19 is a gas spring, it should be understood that other, similar passive resistance mechanisms may be used including, without limitation, spring, elastic bands, or the like.

Figure 20:
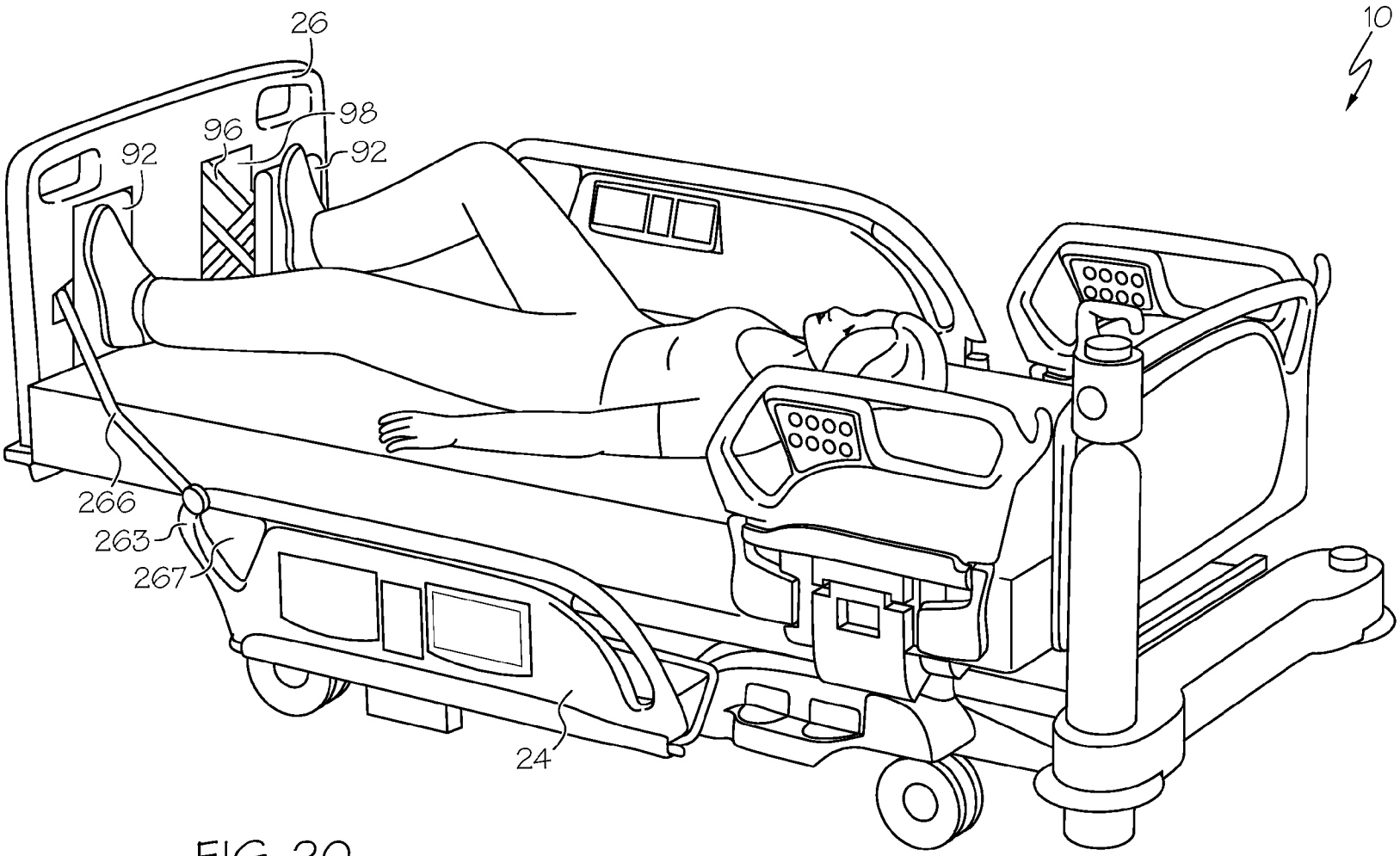
FIG. 20 depicts a person support apparatus having pedals extending from the footboard and employing straps to provide resistance according to one or more embodiments.

As shown in FIG. 20, the footboard 26 includes foot pedals 92 similar to those described in accordance with FIG. 14, except that elastic bands 266 provide resistance. In this embodiment, foot pedals 92 that are held to the footboard 26 via a scissors lift system 96, as described above with respect to FIG. 14. Attached to the foot pedals 92 are elastic bands 266, which are rubber physical therapy bands in this embodiment such as, for example, THERA-BAND brand elastic bands. The elastic bands 266 connect to each pedal 92 and to a portion of the person support apparatus 10. For example, in the embodiment depicted in FIG. 20, the elastic bands are connected to the grip portion 263 of the side rail 24 which defines the aperture 267 of the side rail 24. However, it should be understood that the elastic bands 266 may be attached to other portions of the person support apparatus 10, such as the upper frame, lower frame or the like. To attach the bands between the pedal 92 and the person support apparatus 10, the pedal 92 is first deployed from the footboard 26 and the elastic band 266 is attached to the pedal. Next, the band 266 is extended until it begins to elastically deform and then is connected to the person support apparatus 10, such as to the grip 263 of the side rail 24. In some embodiments, this can be accomplished by tying the elastic band 266 to the grip 263 (or to some other part of the person support apparatus 10), or by engaging a loop on the band 266 to a hook on each of the pedal 92 and the side rail 24. Accordingly, the elastic band 266 biases the pedal 92 to a fully extended state (shown by the right-side pedal in FIG. 20). When the pedal 92 is depressed against the bias of the elastic band 266, the elastic band is further stretched, thereby providing resistance. The band 266 can be tightened to provide additional resistance (such as by stretching it further before attaching it to the pedals 92 and/or the side rail 24). The elastic band can be formed into multiple loops to provide additional resistance or, alternatively, multiple bands may be used including elastic bands with different elastic properties.

Bicycle Pedals

Figure 21:
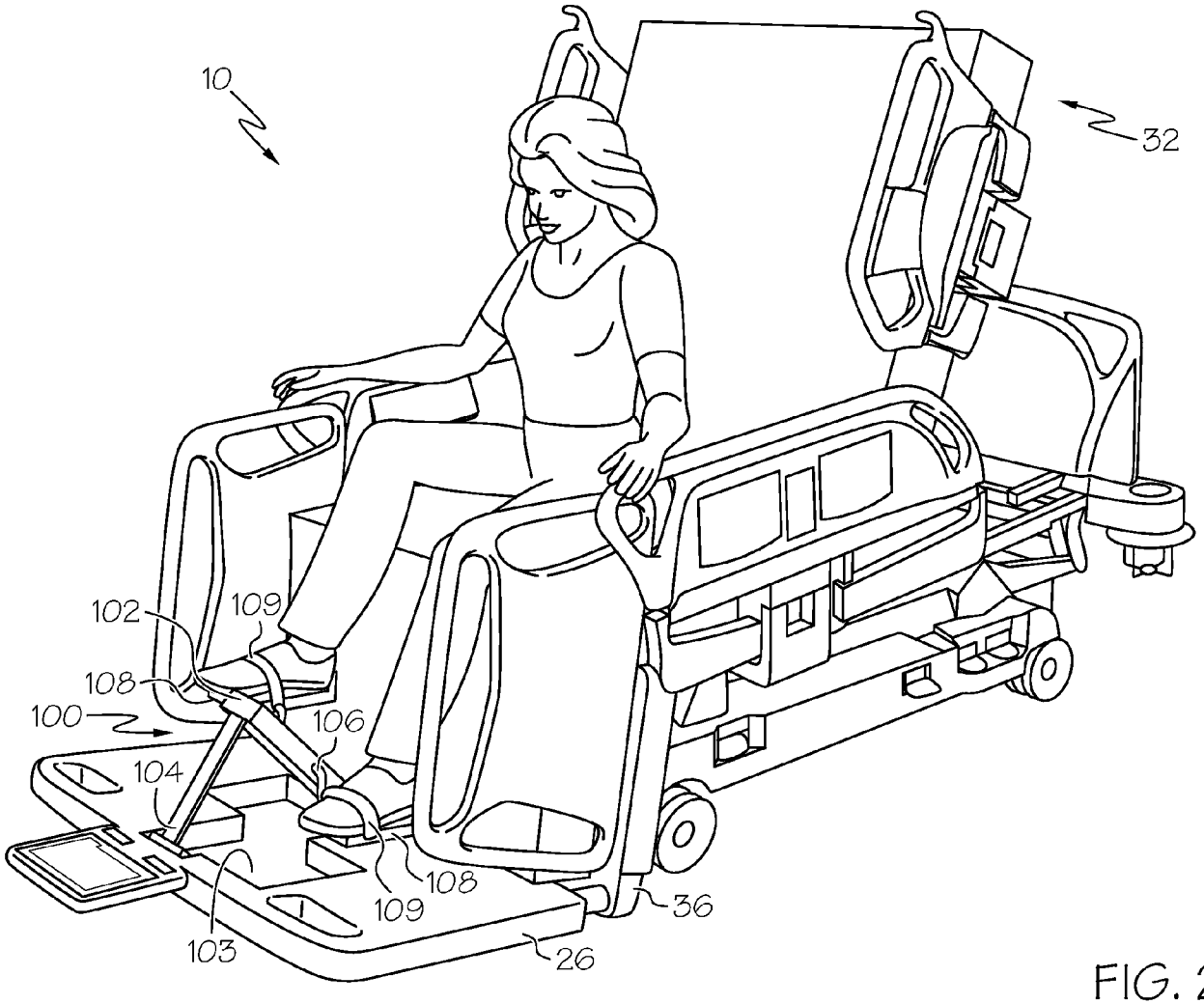
FIG. 21 depicts a person support apparatus having a footboard including bicycle pedals according to one or more embodiments.

FIG. 21 depicts an embodiment of a person support apparatus 10 in which the footboard 26 includes a bicycle physical therapy system 100. The bicycle physical therapy system 100 includes a main column 102 which is pivotally attached to the footboard 26 at one end such that the bicycle physical therapy system 100 can be deployed from a storage recess 103 formed in the footboard 26 and folded back into the storage recess 103 and secured when not in use. The bicycle physical therapy system may also include a sliding link 104 pivotally attached to the footboard 26 and slidably attached to the main column 102. The sliding link 104 supports the main column 102 when the bicycle physical therapy system 100 is in the deployed position, thereby preventing the bicycle physical therapy system 100 from folding back into the storage recess 103 as force is exerted on the bicycle physical therapy system 100 by a user. A pair of pedals 108 connects to the main column 102 by crank arms 106 which extend through the main column 102 and link the pedals 108. The crank arms 106 may be supported by one or more bearings internal to the main column 102 to facilitate the rotation of the crank arms 106 and pedals 108 with respect to the main column 102. The pair of pedals 108 is rotatably attached to the crank arms 106. The bicycle physical therapy system 100 may further include straps 109 attached to each of the pedals 108. The straps may be used to secure a person's feet to the pedals 108 while the person rotates the crank arms 106.

To utilize the bicycle physical therapy system 100, the person support apparatus 10 is moved into a chair-like position by pivoting the head section 32 upward, and pivoting the foot section 36 and attached footboard 26 downward, as depicted in FIG. 21. In this position, the footboard 26 is in a nearly horizontal position, and the person can seated on the person support apparatus 10 with his or her feet engaged with the pedals 108 of the bicycle physical therapy system 100. The user may then rotate the pedals 108 to perform a bicycle-like exercise.

Figure 22B:
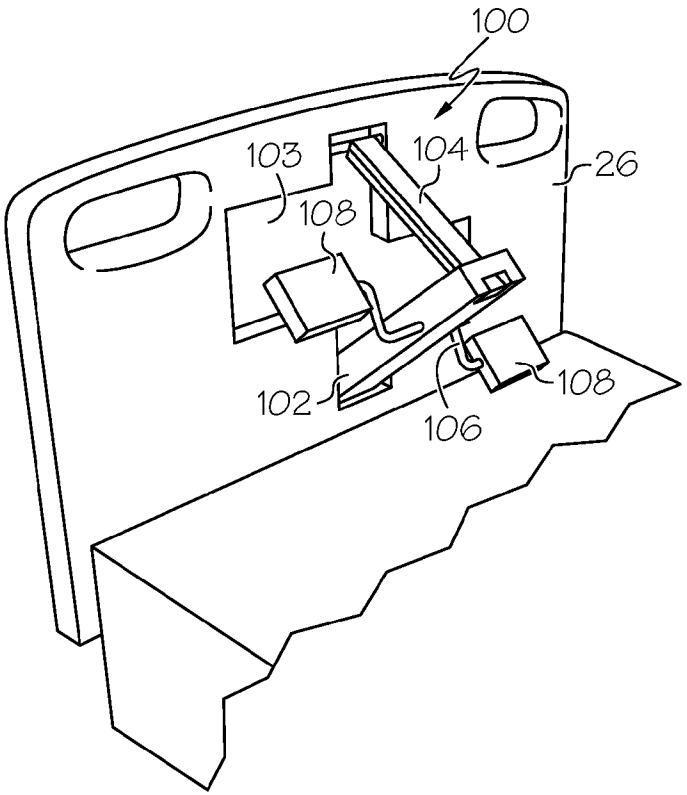
FIG. 22 depicts the bicycle pedals of FIG. 21 in a stowed (FIG. 22A) and in a deployed (FIG. 22B) position.
Figure 22A:
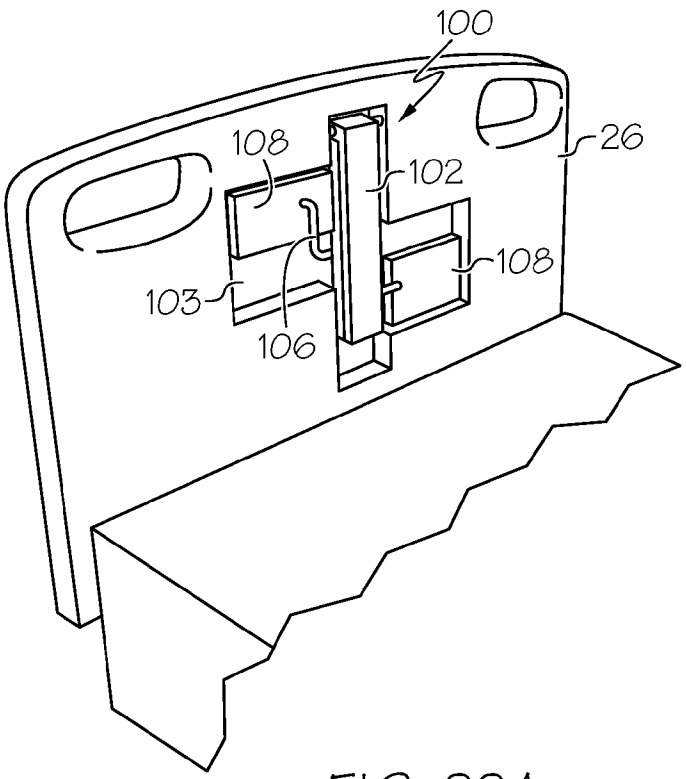

Once the exercise is completed, the pedals 108, main column 102, and link 104 can be pushed down into the storage recess 103 formed in the footboard 26 and stored by latching the bicycle physical therapy system 100 into place, as shown in FIG. 22A. Specifically, FIG. 22A depicts the person support apparatus 10 of FIG. 21, showing the bicycle physical therapy system 100 in a stowed position, while FIG. 22B illustrates the bicycle physical therapy system 100 in the deployed position. As shown in FIG. 22A, the main column 102, link 104, pedals 108, and crank arm 106, are folded into the storage recess 103 in the footboard 26 when in the stowed position of FIG. 22A. When in the deployed position of FIG. 22B, the main column 102 is pivoted outward and is held in position by the link 104, enabling the pedals 108 and the crank arm 106 to be deployed from the footboard 26.

Figure 23:
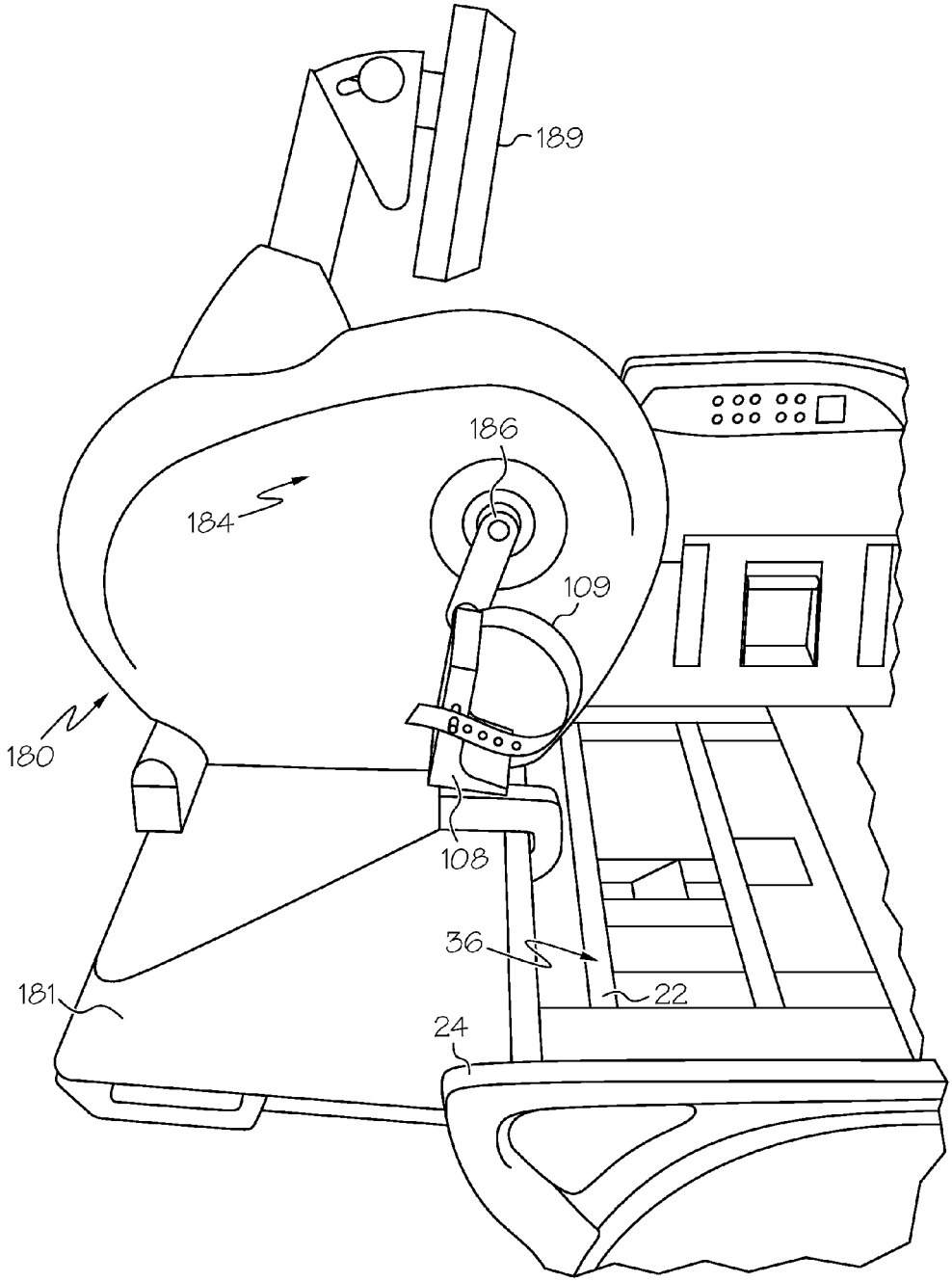
FIG. 23 depicts a bicycle apparatus for use with a person support apparatus according to one or more embodiments.

In some embodiments, the bicycle pedals may be coupled to a passive resistance mechanism. For example, FIG. 23 depicts one embodiment of a person support apparatus 10 which includes a stationary-type bicycle apparatus 180 mounted on the foot section 36 of the deck 22. The bicycle apparatus 180 is mounted on base plate 181 supported by the foot section 36. The bicycle apparatus 180 includes a housing 184 that includes a resistance flywheel that is turned by a crank arm 186. The crank arm 186 is connected a pair of pedals 108. The feet of the person can be held to the pedals 108 with straps 109. A user interface 189 may provide feedback to the person about their use of the bicycle apparatus 180 for cycling type physical therapy, which can provide aerobic, strengthening, and/or physical therapy benefits to the person. In embodiments, the housing 184 may include a power connector that receives a power cord, or the bicycle apparatus 180 may be powered by the power system of the person support apparatus 10. Alternatively, the bicycle apparatus 180 may be powered by an inductive power transmitter connected to the electronics system of the person support apparatus 10 which provides power to an inductive power receiver in or near the bicycle apparatus 180 to provide power to the system.

Low Friction Surface and Rollers

Figure 24:
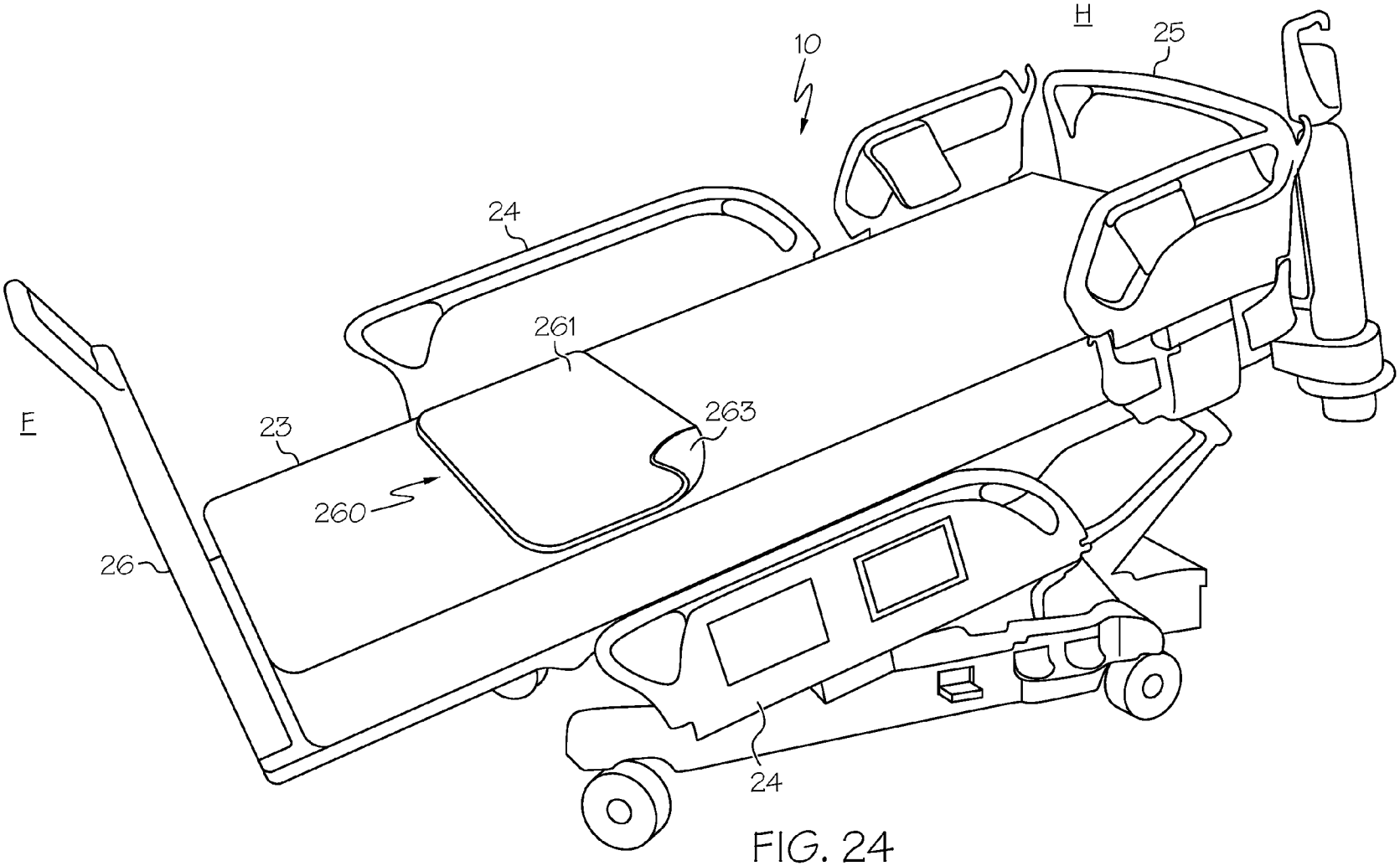
FIG. 24 depicts a person support apparatus including a pad having a low friction surface according to one or more embodiments.

FIG. 24 depicts another embodiment of a person support apparatus 10 which includes an exercise pad 260. In this embodiment, the exercise pad 260 comprises a top surface 261 formed from a first material and a bottom surface 263 formed from a second material. The first material may have a relatively high coefficient of friction such as, for example, latex rubber, synthetic rubber, or the like. The second material may have a relatively low coefficient of friction relative to the surface of the mattress 23. Suitable materials may include, for example, a vinyl material reinforced with polyester which, collectively, has a low coefficient of friction. For example, the second material may be a vinyl coated polyester material having a coefficient of static friction less than or equal to about 0.18.

In use, the exercise pad 260 may be positioned on the top surface of the mattress 23 of the person support apparatus 10 such that the bottom surface 263 of the exercise pad 260 faces and is in contact with the mattress 23. A user may then be seated on the exercise pad 260 such that the user is in contact with the top surface 261 of the exercise pad 260 and the user's feet are in contact with the footboard 26. The person support apparatus 10 may then be inclined such that the head end H is higher than the foot end F. With the person support apparatus 10 in this orientation, the user may perform a leg-press type exercise against the footboard 26 using his or her own weight as resistance. For example, as the person support apparatus 10 is inclined, the low coefficient of friction between the bottom surface 263 of the exercise pad 260 and the mattress 23 causes the exercise pad 260 and user to slide towards the footboard 26. The relatively high coefficient of friction of the top surface 261 of the exercise pad 260 keeps the user engaged and coupled to the exercise pad 260. The user may resist and slow this sliding motion by pressing against the footboard 26 while lowering themselves towards the footboard 26 by bending at the knee. A user may complete the leg-press type exercise by pushing against the footboard 26 as he or she straightens their legs, thereby sliding the exercise pad 260 towards the head end H of the person support apparatus 10. It should be understood that the amount of resistance experienced by a user while using the exercise pad 260 may be varied by adjusting the angle of inclination of the person support apparatus 10.

In the embodiments described herein, the exercise pad 260 may be a removable device, or it may be integrated into the person support apparatus 10. For example, the exercise pad 260 may be stored within a recess of one of the side rails 24 and deployed from the side rail 24 to enable the person to perform one or more exercises.

Figure 25:
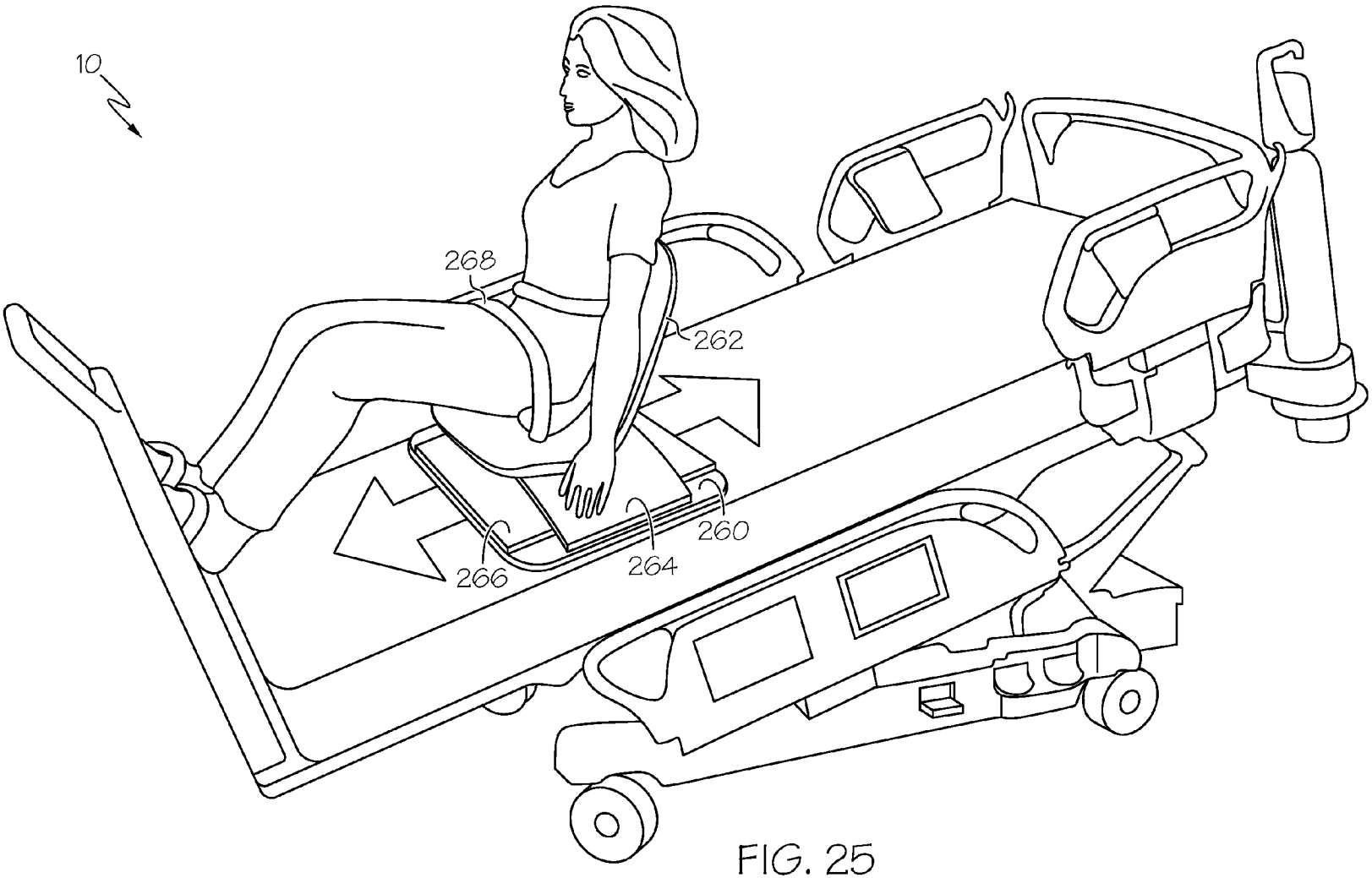
FIG. 25 depicts a person support apparatus having a pad having a low friction surface coupled with a seat according to one or more embodiments.

Referring now to FIG. 25, another embodiment of an exercise pad 260 is depicted. In this embodiment, the exercise pad 260 is affixed to a seat 262. For example, a padded seat 262 may be mounted to a flexible support 264 that is affixed to a base 266 including the exercise pad 260. Straps 268 may be included to secure the person to the seat 262. As in the previous embodiment, the pad 260 includes a bottom surface formed from a low friction material. In embodiments, the seat 262 may be slid beneath the person and the support surface may be tilted to enable the person to perform one or more leg presses using his or her own body weight as the resistance mechanism, as described above. In some embodiments, the seat 262 may be hinged to facilitate sliding the seat 262 beneath the person.

Figure 26:
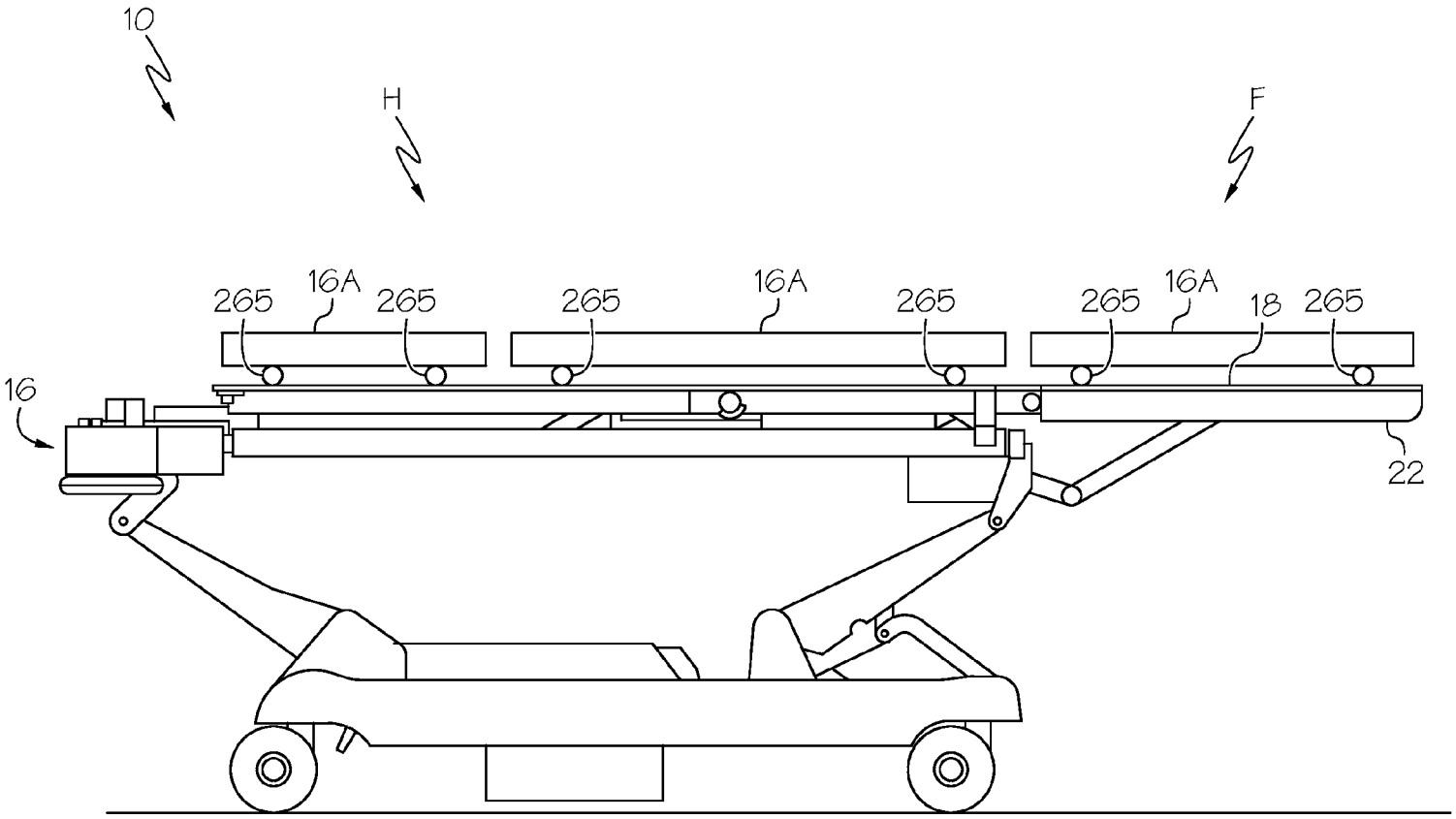
FIG. 26 depicts a person support apparatus having a nested frame according to one or more embodiments.

Turning now to FIG. 26, various embodiments may also include a nesting frame 16A. In such embodiments, the nesting frame 16A may be provided on top of the deck 22 of the person support apparatus 10. The nesting frame 16A includes one or more rollers 265 on which a mattress or similar support surface may rest. When positioned on the nesting frame 16A, the mattress may slide between the head end H and the foot end F of the upper frame 16. When engaged, the nesting frame 16A enables a person on the support surface 18 to move relative to the upper frame 16, such as in order to perform a leg press exercise. In such embodiments, the footboard 26 may be fixed relative to the upper frame 16. The person may push against the footboard 26 to provide a force sufficient to roll towards the head end H of the support surface 18.

Electronic Control System

Figure 27:
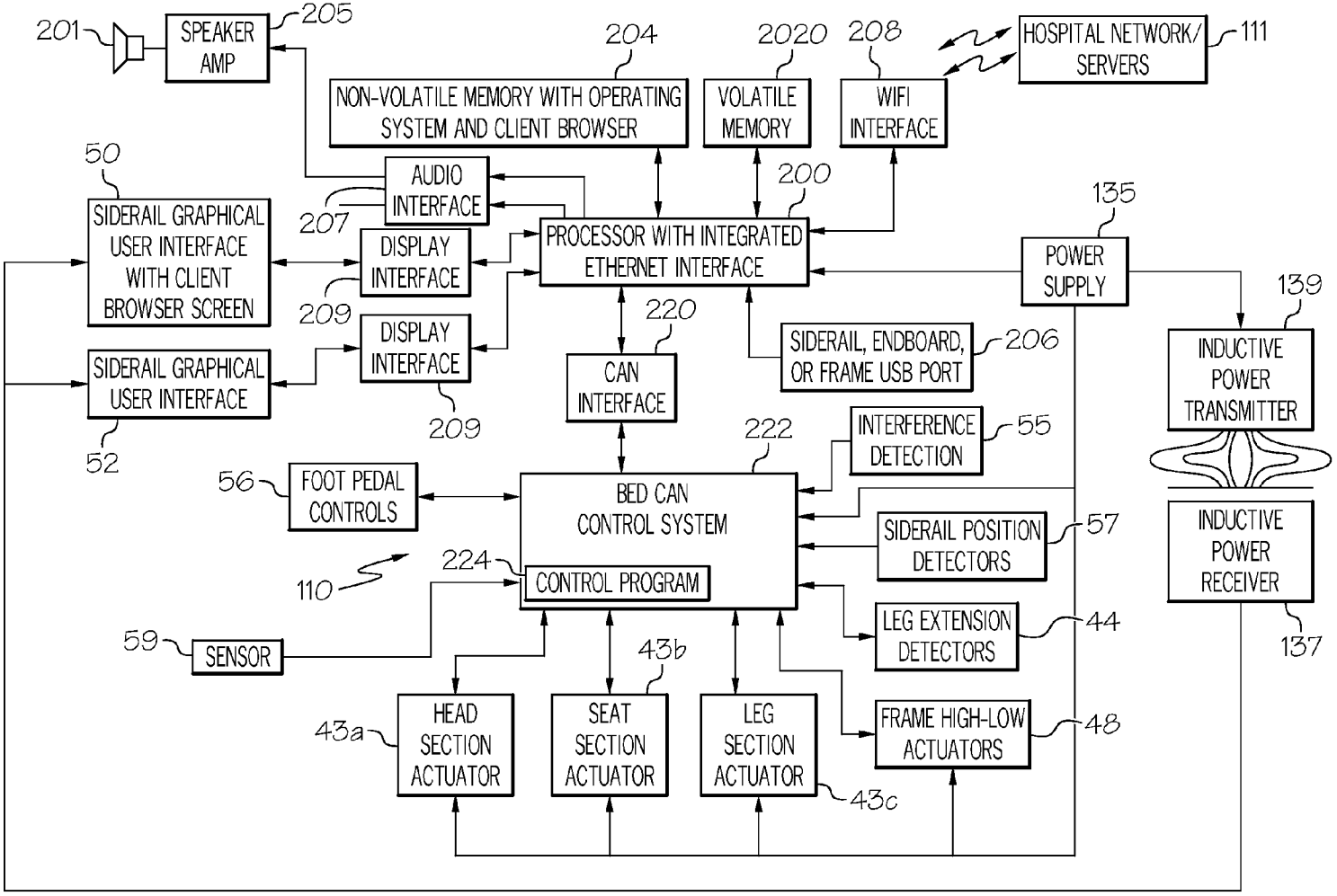
FIG. 27 depicts an electronic control system providing control of various features according to one or more embodiments.

FIG. 27 is a block diagram of an embodiment of an electronic control system 110 that provides control of various functions of the person support apparatus 10 described herein. In embodiments including an extendible leg section 36, the electronic control system 110 operates and monitors a linear actuator 44 to extend and retract the extendible leg section 36. The electronic control system 110 may further operate and monitor other linear actuators 48 in order to move the upper frame 16 relative to the lower frame 12. In various embodiments, the electronic control system 110 further operates and monitors linear actuators 43*a-c* to pivot the head portion 32 relative to the upper frame 16, the seat portion 34 relative to the upper frame 16, and the foot portion 36 relative to the upper frame 16.

The electronic control system 110 may include a plurality of input devices, including one or more graphical user interfaces 50, 52 and the foot pedal controls 56 that are coupled to the lower frame 12. A controller area network system 222 may execute a control program 224 to control the various actuators and components. Such a system can include one or more controller area network (CAN) controller nodes to control the various actuators. If multiple controller nodes are utilized, the nodes can communicate with one another via serial bus connections. The control program 224 may further include additional control software or other logic that indicates desired control logic for the person support apparatus 10, such as to control which actuators to operate in response to which user inputs, what displays on the user interfaces 50, 52 at what times, how to convert data from sensor 59 into person weight, and what alarms to sound via speaker 201 and/or user interfaces 50, 52 in response to inputs (side rails up/down, brakes set/notset, bed low/notlow, person position). The control program 224 may be stored in the electronics system 110, or may be stored remotely and accessed by the electronics system 110 via a network connection.

A microprocessor 200 communicates with the controller area network system 222 via a CAN interface circuit 220. Accordingly, the microprocessor 200 can receive inputs indicating the force provided by the person on the therapy mechanisms described herein, and allow for feedback to be provided to the person during such therapy.

The CAN interface circuit 220 allows the microprocessor 200 to deliver input commands to the controller area network system 222 to perform a variety of functions, such as to move an actuator or set an alarm signal. The CAN interface circuit 220 further enables the controller area network system 222 to deliver actuator status information and other information to the microprocessor 200, which may be displayed on the user interfaces 50 and 52. The CAN interface circuit 220 includes appropriate circuitry or integrated circuitry that allows the microprocessor 200 to communicate with the controller area network system 222. The CAN interface circuit 220 may be, for example, a high speed CAN transceiver.

The microprocessor 200 communicates with and drives the graphical user interfaces 50 and 52 via one or more display interfaces 209. The display interfaces 209 include appropriate driver or interface circuitry for driving displays. Additionally, the microprocessor 200 may drive a speaker amplifier 205 to permit audio through the speaker 201. Accordingly, alarms, music, nature sounds and other sounds can be driven by the microprocessor 200 through the speaker 201 and/or the user interfaces 50 and 52.

In the embodiment illustrated in FIG. 27, the electronic control system 110 of the person support apparatus 10 includes a Wi-Fi interface 208. The Wi-Fi interface 208 allows the microprocessor 200 to communicate to a hospital server 111 (and/or to other equipment) via a wireless local area network communication protocol.

In some embodiments, the electronic control system 110 may further include a power supply 135. The power supply 135 may be, for example, a battery or connection to an alternating current power source. The power supply 135 may provide power to various components of the electronic control system 110. Additionally, the power supply 135 may provide power to an inductive power transmitter 139. The inductive power transmitter 139 can provide power to an inductive power receiver 137 incorporated into one or more features described herein. For example, an inductive power transmitter 139 may be supported by the upper frame 16, and an inductive power receiver 137 may be supported by the footboard 26. The transmitter 139 is connected with the power supply 135 and induces power in the receiver 137 to operate the user interface 52 of the footboard 26. Accordingly, a variety of footboards 26 having electronics could be attached to the person support apparatus 10, and interchanged therewith, such as those described herein, without need for physically plugging in the footboards or having them connect directly with the electronic control system 110. Rather, the power to the footboard 26 may be provided wirelessly through the transmitter 139 and receiver 137, and the footboard 26 may operate as a standalone module.

Other components or parts of the person support apparatus 10 may be powered by such power transmitter/receiver arrangements, such as side rails, headboards, user interfaces and the like. Examples of wireless power transmitters and receivers are those having transmit and receive coils respectively, such as those provided by Wurth Electronics and having Texas Instruments inductive transmitter and receiver manager integrated circuits.

In various embodiments, the physical therapy systems (bicycle systems, footboards, pedals, etc.) may be removable. The features may be removed individually (e.g., the pedals may be removed from the footboard to which they are attached), or the footboard including the features may be removed by pulling the footboard from the frame/deck. Accordingly, various physical therapy systems can be interchanged with a single person support apparatus simply by changing the footboard. Thus, a caregiver may have a variety of footboards stored in the caregiver facility, each with a different type of physical therapy system attached thereto, such that a variety of physical therapy exercises can be provided on a given bed, depending on the person and the person's needs.

Many additional embodiments other than those described above are possible and still included in the spirit and scope of the claims defining the embodiments described herein. For example, although various combinations of features of a person support apparatus have been shown and described, it is contemplated that these features may be combined in other ways described in detail or illustrated in the accompanying figures.

In a first aspect, the disclosure provides a person support apparatus comprising a support surface having a foot end and a head end, a footboard located near the foot end of the support surface and extending above the support surface, a sensor, and a passive resistance mechanism. The footboard comprises a pressure surface positioned to receive a pressing force. The footboard is freely slidable from an extended position to a retracted position with respect to the foot end. The passive resistance mechanism is coupled to the footboard and resists a motion of the footboard to the extended position. The sensor is configured to provide a signal indicative of a magnitude of the pressing force incident on the pressure surface of the footboard.

In a second aspect, the disclosure provides the person support apparatus of the first aspect, the support surface further including an extendable foot section near the foot end of the support surface and the footboard is coupled to the extendable foot section.

In a third aspect, the disclosure provides the person support apparatus of the first or second aspects further including a frame, wherein the frame supports at least the support surface, the footboard, and the sensor.

In a fourth aspect, the disclosure provides the person support apparatus of any of the first through third aspects, wherein the passive resistance mechanism biases the footboard to a neutral position.

In a fifth aspect, the disclosure provides the person support apparatus of the fourth aspect, wherein the neutral position is intermediate between the extended position and the retracted position.

In a sixth aspect, the disclosure provides the person support apparatus of the fourth aspect, wherein the neutral position is the retracted position.

In a seventh aspect, the disclosure provides the person support apparatus of any of the first through sixth aspects, further including a user interface displaying information regarding exercise performed with the footboard.

In an eighth aspect, the disclosure provides the person support apparatus of the seventh aspect, wherein the information regarding exercise comprises at least one of exercise repetitions, exercise time, exercise encouragement, and exercise force.

In a ninth aspect, the disclosure provides the person support apparatus of the seventh or eighth aspects, wherein the user interface comprises at least one of an LCD screen and a touchscreen display.

In a tenth aspect, the disclosure provides the person support apparatus of any of the seventh through ninth aspects, further including a system controller communicatively coupled to the sensor and the user interface, wherein the displayed information regarding exercise relates to the force applied to the sensor.

In an eleventh aspect, the disclosure provides the person support apparatus of any of the first through tenth aspects, wherein the sensor is configured to detect a varying magnitude of the pressing force.

In a twelfth aspect, the disclosure provides the person support apparatus of any of the first through eleventh aspects, further including a mattress comprising a top surface having raised supports extending above the support surface.

In a thirteenth aspect, the disclosure provides the person support apparatus of any of the first through twelfth aspects, wherein the footboard comprises at least one securing strap for securing a foot to the footboard adjacent the pressure surface.

In a fourteenth aspect, the disclosure provides the person support apparatus of any of the first through thirteenth aspects, further including a lift system configured to move the support surface between a raised position and a lowered position, and a side rail extending along a side of the support surface and movable between a raised position and a lowered position, wherein the support surface comprises deck sections pivotable relative to one another.

In a fifteenth aspect, the disclosure provides the person support apparatus of any of the first through fourteenth aspects, wherein the sensor comprises a load cell.

In a sixteenth aspect, the disclosure provides the person support apparatus of any of the first through fifteenth aspects, wherein the sensor is coupled with the footboard.

In a seventeenth aspect, the disclosure provides the person support apparatus of any of the first through sixteenth aspects, wherein the footboard is retractable.

In an eighteenth aspect, the disclosure provides the person support apparatus of any of the first through seventeenth aspects, further including an actuator for actively driving the footboard between the extended position and the retracted position, wherein the actuator is disengageable from the footboard.

In a nineteenth aspect, the disclosure provides the person support apparatus of the eighteenth aspect, wherein the passive resistance mechanism is engaged when the actuator is disengaged from the footboard.

In a twentieth aspect, the disclosure provides the person support apparatus of the eighteenth or nineteenth aspects, wherein the passive resistance mechanism comprises an air spring.

In a twenty-first aspect, the disclosure provides the person support apparatus of the twentieth aspect, wherein the air spring supplies variable resistance when the actuator is disengaged from the footboard.

In a twenty-second aspect, the disclosure provides the person support apparatus of any of the first through eighteenth aspects, wherein the passive resistance mechanism comprises an air spring.

In a twenty-third aspect, the disclosure provides the person support apparatus of any of the third through twenty-second aspects, wherein at least one of the footboard and the sensor are directly supported by the support surface and indirectly supported by the frame.

In a twenty-fourth aspect, the disclosure provides the person support apparatus of any of the third through twenty-third aspects, wherein the footboard is freely slidable relative to the frame.

In a twenty-fifth aspect, the disclosure provides the person support apparatus of any of the third through twenty-fourth aspects, further including one or more grips extending from the frame over the support surface.

In a twenty-sixth aspect, the disclosure provides the person support apparatus of the twenty-fifth aspect, wherein the one or more grips is freely slidable relative to the frame, the footboard, or the frame and the footboard.

In a twenty-seventh aspect, the disclosure provides the person support apparatus of any of the first through twenty-sixth aspects, further including one or more grips positioned over the support surface.

In a twenty-eighth aspect, the disclosure provides the person support apparatus of the twenty-fifth through twenty-seventh aspects, wherein the one or more grips comprise a grip resistance mechanism resisting a motion of the one or more grips.

In a twenty-ninth aspect, the disclosure provides a person support apparatus that includes a frame, a support surface supported by the frame and having a head end and a foot end, at least one side rail provided along at least one side of the support surface, and a foot pedal. The foot pedal is supported by at least one of the at least one side rail and the frame, and located closer to the foot end than the head end. The foot pedal is freely slidable with respect to the support surface from a retracted position to an extended position. The foot pedal is also coupled to a passive resistance mechanism that resists a motion of the foot pedal.

In a thirtieth aspect, the disclosure provides the person support apparatus of the twenty-ninth aspect, wherein the foot pedal extends from the at least one side rail.

In a thirty-first aspect, the disclosure provides the person support apparatus of the twenty-ninth or thirtieth aspects, wherein the foot pedal includes a pivot axis and is foldable about the pivot axis.

In a thirty-second aspect, the disclosure provides the person support apparatus of any of the twenty-ninth through thirty-first aspects, wherein the passive resistance mechanism provides variable resistance.

In a thirty-third aspect, the disclosure provides the person support apparatus of any of the twenty-ninth through thirty-second aspects, wherein the passive resistance mechanism comprises a spring.

In a thirty-fourth aspect, the disclosure provides the person support apparatus of any of the twenty-ninth through thirty-third aspects, further including a footboard provided near the foot end of the support surface and extending above the support surface.

In a thirty-fifth aspect, the disclosure provides the person support apparatus of the thirty-fourth aspect, wherein the foot pedal is supported by the footboard and indirectly by the frame.

In a thirty-sixth aspect, the disclosure provides the person support apparatus of the thirty-fourth or thirty-fifth aspects, wherein the foot pedal extends from the footboard toward the head end of the support surface.

In a thirty-seventh aspect, the disclosure provides the person support apparatus of any of the thirty-fourth through thirty-sixth aspects, wherein the footboard includes a vertical surface extending above the support surface.

In a thirty-eighth aspect, the disclosure provides the person support apparatus of the thirty-seventh aspect, wherein the foot pedal forms a portion of the vertical surface.

In a thirty-ninth aspect, the disclosure provides the person support apparatus of any of the thirty-fourth through thirty-eighth aspects, wherein the footboard is fixed relative to the frame.

In a fortieth aspect, the disclosure provides the person support apparatus of any of the thirty-fourth through thirty-ninth aspects, wherein the foot pedal is integrally formed with the footboard.

In a forty-first aspect, the disclosure provides the person support apparatus of the fortieth aspect, wherein the footboard includes a first section and a second section, the sections being pivoted relative to one another such that a portion of the height of the footboard is reduced. The foot pedal is mounted to the first section.

In a forty-second aspect, the disclosure provides the person support apparatus of any of the thirty-fourth through forty-first aspects, wherein the passive resistance mechanism is mounted on the footboard and includes a spring mechanism.

In a forty-third aspect, the disclosure provides the person support apparatus of the forty-second aspect, wherein the spring mechanism comprises a gas spring.

In a forty-fourth aspect, the disclosure provides the person support apparatus of any of the thirty-fourth through forty-third aspects, wherein the footboard is removably attached to the apparatus.

In a forty-fifth aspect, the disclosure provides the person support apparatus of any of the thirty-fourth through forty-first aspects, wherein the passive resistance mechanism includes a weight. The passive resistance mechanism is mounted to the footboard.

In a forty-sixth aspect, the disclosure provides the person support apparatus of the forty-fifth aspect, wherein the weight is connected to the foot pedal and the weight resides on the outside of the footboard.

In a forty-seventh aspect, the disclosure provides the person support apparatus of the forty-fifth or forty-sixth aspect, wherein the foot pedal is connected to the weight via a pulley.

In a forty-eighth aspect, the disclosure provides the person support apparatus of the forty-fifth or forty-sixth aspect, wherein the foot pedal is connected to the weight via a cable.

In a forty-ninth aspect, the disclosure provides the person support apparatus of any of the twenty-ninth through forty-first aspects, wherein the passive resistance mechanism includes a scissors link system.

In a fiftieth aspect, the disclosure provides the person support apparatus of the forty-ninth aspect, wherein the scissors link system includes a biasing mechanism that biases the foot pedal toward the head end of the support surface.

In a fifty-first aspect, the disclosure provides the person support apparatus of any of the twenty-ninth through forty-first aspects, wherein the foot pedal includes a crank arm configured to be rotated.

In a fifty-second aspect, the disclosure provides the person support apparatus of the fifty-first aspect, wherein the crank arm is attached to a base that attaches to a footboard.

In a fifty-third aspect, the disclosure provides the person support apparatus of the fifty-first or fifty-second aspects, wherein the crank arm is attached to a flywheel mounted to the foot section.

In a fifty-fourth aspect, the disclosure provides the person support apparatus according to any one of the twenty-ninth through fifty-third aspects, wherein the foot pedal and/or the passive resistance mechanism are removably attached to the apparatus.

In a fifty-fifth aspect, the disclosure provides the person support apparatus according to any one of the twenty-ninth through fifty-fourth aspects, wherein the foot pedal is supported by and located above the foot section of the support surface.

In a fifty-sixth aspect, the disclosure provides the person support apparatus according to the fifty-fifth aspect, wherein the passive resistance mechanism comprises a flywheel supported by and located above the foot section of the support surface.

In a fifty-seventh aspect, the disclosure provides the person support apparatus according to the fifty-sixth aspect, wherein the flywheel is at least partially contained within a housing supported by and located above the foot section of the support surface.

In a fifty-eighth aspect, the disclosure provides the person support apparatus according to the fifty-seventh aspect, wherein the foot pedal comprises a pair of foot pedals, one on each side of the housing.

In a fifty-ninth aspect, the disclosure provides the person support apparatus according to any one of the twenty-ninth through fifty-eighth aspects, further including a user interface.

In a sixtieth aspect, the disclosure provides the person support apparatus according to the fifty-ninth aspect, further including a sensor sensing movement of the foot pedal, wherein the user interface displays a parameter based upon a signal from the sensor.

In a sixty-first aspect, the disclosure provides the person support apparatus according to any of the twenty-ninth through sixtieth aspects, wherein the foot pedal comprises a pair of foot pedals, and wherein the mechanical resistance is rotatable by the foot pedals.

In a sixty-second aspect, the disclosure provides the person support apparatus according to any of the twenty-ninth through sixty-first aspects, further including a cam configured to cause the passive resistance mechanism to provide variable resistance during movement.

In a sixty-third aspect, the disclosure provides a person support apparatus that includes a frame, a support surface having a head end and a foot end supported by the frame, at least one side rail provide along at least one side of the support surface, and a physical therapy bar supported by at least one of the side rail and the frame, wherein the physical therapy bar is movable against a force provided by a passive resistance mechanism.

In a sixty-fourth aspect, the disclosure provides the person support apparatus of the sixty-third aspect, wherein the physical therapy bar is movable between a retracted position and an extended position.

In a sixty-fifth aspect, the disclosure provides the person support apparatus of the sixty-third or sixty-fourth aspects, further including a cam configured to cause the passive resistance mechanism to provide a variable resistance during movement.

In a sixty-sixth aspect, the disclosure provides the person support apparatus of any of the sixty-third through sixty-fifth aspects, wherein the physical therapy bar is connected to the frame.

In a sixty-seventh aspect, the disclosure provides the person support apparatus according to the sixty-sixth aspect, wherein the physical therapy bar is pivotable relative to the frame and extends downward from the frame when in the extended position.

In a sixty-eighth aspect, the disclosure provides the person support apparatus according to any of the sixty-third through sixty-seventh aspects, wherein the physical therapy bar includes a pad.

In a sixty-ninth aspect, the disclosure provides the person support apparatus according to any of the sixty-fourth through sixty-eighth aspects, wherein the physical therapy bar is pivotable upwardly and beneath the support surface to the retracted position.

In a seventieth aspect, the disclosure provides a person support apparatus that includes a support surface having a head end and a foot end, a lift system configured to tilt the support surface, a footboard located near the foot end of the support surface and extending above the support surface, and a pad. The pad includes a low friction material facing the support surface, wherein the low friction material enables the pad to slide along the support surface relative to the footboard.

In a seventy-first aspect, the disclosure provides the person support apparatus of the seventieth aspect, wherein the lift system operates to tilt the support surface into a Trendelenburg position or a reverse Trendelenburg position.

In a seventy-second aspect, the disclosure provides the person support apparatus of the seventieth or seventy-first aspects, wherein the pad is affixed to a seat.

In a seventy-third aspect, the disclosure provides the person support apparatus of the seventy-second aspect, wherein the pad is affixed to the seat by being affixed to a base to which a flexible plastic support affixed to the seat is mounted.

In a seventy-fourth aspect, the disclosure provides the person support apparatus according to any one of the seventieth through seventy-third aspects, wherein the low friction material is a vinyl reinforced with polyester.

In a seventy-fifth aspect, the disclosure provides the person support apparatus according to any one of the seventieth through seventy-fourth aspects, wherein the pad deploys from a side rail provided along at least one side of the support surface.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

The invention claimed is:

1. A person support apparatus, comprising: a support surface having a foot end and a head end; a footboard located near the foot end of the support surface and extending above the support surface, the footboard comprising a pressure surface positioned to receive a pressing force wherein the footboard is freely slidable from an extended position to a retracted position with respect to the foot end when the footboard is decoupled from an actuator for actively driving the footboard between the extended position and the retracted position; a sensor to provide a signal indicative of a magnitude of the pressing force incident on the pressure surface of the footboard; and a passive resistance mechanism coupled to the footboard, the passive resistance mechanism resisting a motion of the footboard to the extended position.

2. The person support apparatus of claim 1, further comprising a frame, wherein the frame supports at least the support surface, the footboard, and the sensor.

3. The person support apparatus of claim 2, wherein the footboard is slidable relative to the frame.

4. The person support apparatus of claim 1, wherein the support surface further comprises an extendable foot section near the foot end of the support surface and the footboard is coupled to the extendable foot section.

5. The person support apparatus of claim 4, further comprising a frame, wherein the frame supports at least the support surface, the footboard, and the sensor.

6. The person support apparatus of claim 5, wherein the footboard is slidable relative to the frame.

7. The person support apparatus of claim 1, wherein the sensor detects a varying magnitude of the pressing force.

8. The person support apparatus of claim 1, wherein the sensor is coupled with the footboard.

9. The person support apparatus of claim 1, wherein the footboard is retractable.

10. The person support apparatus of claim 1, wherein the passive resistance mechanism comprises an air spring.

* * * * *